US010457877B2

(12) United States Patent
Dandekar et al.

(10) Patent No.: US 10,457,877 B2
(45) Date of Patent: Oct. 29, 2019

(54) LUBRICANT BASESTOCK PRODUCTION WITH ENHANCED AROMATIC SATURATION

(71) Applicant: ExxonMobil Research and Engineering Company, Annandale, NJ (US)

(72) Inventors: Ajit B. Dandekar, Clinton, NJ (US); Bradley R. Fingland, Mason, MI (US); Kendall S. Fruchey, Easton, PA (US); Scott J. Weigel, Allentown, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 154 days.

(21) Appl. No.: 15/468,406

(22) Filed: Mar. 24, 2017

(65) Prior Publication Data

US 2017/0283717 A1 Oct. 5, 2017

Related U.S. Application Data

(60) Provisional application No. 62/356,749, filed on Jun. 30, 2016, provisional application No. 62/315,808, filed on Mar. 31, 2016.

(51) Int. Cl.
*C10G 65/12* (2006.01)
*C10M 101/02* (2006.01)
(Continued)

(52) U.S. Cl.
CPC ..... *C10G 65/12* (2013.01); *C10G 47/18* (2013.01); *C10G 69/02* (2013.01);
(Continued)

(58) Field of Classification Search
CPC ..... C10G 47/58–66; C10G 65/12
See application file for complete search history.

(56) References Cited

U.S. PATENT DOCUMENTS 3,354,078 A 11/1967 Miale et al.
5,332,566 A 7/1994 Moini
(Continued)

FOREIGN PATENT DOCUMENTS

WO 00/40333 A1 7/2000
WO 2004/007646 A1 1/2004
(Continued)

OTHER PUBLICATIONS

Rosselot, Kirsten and Vicent M. Torres, "Refinery Intermediate Literature Review", p. 24 (Year: 2014).*
(Continued)

*Primary Examiner* — Renee Robinson
(74) *Attorney, Agent, or Firm* — Robert A. Migliorini; Scott F. Yarnell

(57) ABSTRACT

Systems and methods are provided for producing lubricant basestocks having a reduced or minimized aromatics content. A first processing stage can perform an initial amount of hydrotreating and/or hydrocracking. A first separation stage can then be used to remove fuels boiling range (and lower boiling range) compounds. The remaining lubricant boiling range fraction can then be exposed under hydrocracking conditions to a USY catalyst including a supported noble metal, such as Pt and/or Pd. The USY catalyst can have a desirable combination of catalyst properties, such as a unit cell size of 24.30 or less (or 24.24 or less), a silica to alumina ratio of at least 50 (or at least 80), and an alpha value of 20 or less (or 10 or less). In some aspects, the effluent from the second (hydrocracking) stage can be dewaxed without further separation. In such aspects, a portion of the dewaxed effluent can be used as a recycle quench stream
(Continued)

to cool the hydrocracking effluent prior to entering the dewaxing reactor.

17 Claims, 6 Drawing Sheets

(51) Int. Cl.
*C10G 69/02* (2006.01)
*C10G 47/18* (2006.01)

(52) U.S. Cl.
CPC ..... *C10M 101/02* (2013.01); *C10G 2300/202* (2013.01); *C10G 2300/302* (2013.01); *C10G 2400/10* (2013.01); *C10M 2203/1006* (2013.01); *C10M 2203/1025* (2013.01); *C10M 2203/1045* (2013.01); *C10M 2203/1065* (2013.01); *C10N 2220/02* (2013.01); *C10N 2220/022* (2013.01); *C10N 2220/025* (2013.01); *C10N 2230/02* (2013.01); *C10N 2230/08* (2013.01); *C10N 2230/10* (2013.01); *C10N 2240/10* (2013.01); *C10N 2240/12* (2013.01)

(56) References Cited

U.S. PATENT DOCUMENTS

| | | | |
|---|---|---|---|
| 6,156,695 | A | 12/2000 | Soled et al. |
| 6,162,350 | A | 12/2000 | Soled et al. |
| 6,299,760 | B1 | 10/2001 | Soled et al. |
| 6,569,312 | B1 | 5/2003 | Carroll et al. |
| 6,582,590 | B1 | 6/2003 | Riley et al. |
| 6,712,955 | B1 | 3/2004 | Hou et al. |
| 6,783,663 | B1 | 8/2004 | Riley et al. |
| 6,863,803 | B1 | 3/2005 | Riley et al. |
| 6,929,738 | B1 | 8/2005 | Riley et al. |
| 7,229,548 | B2 | 6/2007 | Riley et al. |
| 7,288,182 | B1 | 10/2007 | Soled et al. |
| 7,410,924 | B2 | 8/2008 | Corma Canos et al. |
| 7,544,632 | B2 | 6/2009 | Soled et al. |
| 7,704,930 | B2 | 4/2010 | Deckman et al. |
| 8,114,678 | B2 | 2/2012 | Chawla et al. |
| 8,778,171 | B2 | 7/2014 | Oliveri et al. |
| 8,932,454 | B2 | 1/2015 | Wu et al. |
| 8,992,764 | B2 | 3/2015 | Prentice et al. |
| 2004/0092384 | A1 | 5/2004 | Timken et al. |
| 2005/0277545 | A1 | 12/2005 | Shih et al. |
| 2006/0027486 | A1 | 2/2006 | Rosenbaum et al. |
| 2006/0060502 | A1 | 3/2006 | Soled et al. |
| 2007/0084754 | A1 | 4/2007 | Soled et al. |
| 2008/0132407 | A1 | 6/2008 | Bai et al. |
| 2009/0143261 | A1 | 6/2009 | Takeoka et al. |
| 2010/0070202 | A1 | 3/2010 | Gould et al. |
| 2011/0315596 | A1 | 12/2011 | Prentice et al. |
| 2013/0026070 | A1* | 1/2013 | Oliveri ..... B01J 29/80 208/111.15 |
| 2013/0264246 | A1 | 10/2013 | Holtzer et al. |
| 2013/0341243 | A1 | 12/2013 | Novak et al. |

FOREIGN PATENT DOCUMENTS

| | | | |
|---|---|---|---|
| WO | 2007/084437 | A2 | 7/2007 |
| WO | 2007/084438 | A2 | 7/2007 |
| WO | 2007/084439 | A1 | 7/2007 |
| WO | 2007/084471 | A1 | 7/2007 |

OTHER PUBLICATIONS

The International Search Report and Written Opinion of PCT/US2017/024236 dated Jul. 7, 2017.

The International Search Report and Written Opinion of PCT/US2017/024242 dated Jun. 30, 2017.

Miale, J.N. et al., "Catalysis by Crystalline Aluminosilicates IV. Attainable Catalytic Cracking Rate Constants, and Superactivity", Journal of Catalysis, 1966, vol. 6, pp. 278-287.

Kramer, D.C. et al., "Influence of Group II & III Base Oil Composition on VI and Oxidation Stability", 1999, AIChE Spring National Meeting, Houston, Texas.

Johnson, Marvin F. L., "Estimation of the Zeolite Content of a Catalyst from Nitrogen Adsorption Isotherms", Journal of Catalysis, 1978, vol. 52, pp. 425-431.

Olson, D.H. et al., "Chemical and Physical Properties of the ZSM-5 Substitutional Series", Journal of Catalysis, 1980, vol. 61, pp. 390-396.

Weisz, P.B. et al., "Superactive Crystalline Aluminosilicate Hydrocarbon Catalysts", Journal of Catalysis, 1965, vol. 4, pp. 527-529.

Gatto, V.J. et al., "The Influence of Chemical Structure on the Physical Properties and Antioxidant Response of Hydrocracked Base Stocks and Polyalphaolefins", Journal of Synthetic Lubrication, 2002, vol. 19, issue 4, pp. 3-18.

* cited by examiner

| | | | | Examples of inventive base stocks | | | | Conventional Group II Low Viscosity Basestocks | | | | | | |
|---|---|---|---|---|---|---|---|---|---|---|---|---|---|---|
| 1 | Kinematic Viscosity at 100 C | ASTM D445 | cSt | 5.38 | 5.40 | 5.05 | 5.26 | 5.24 | 5.35 | 5.35 | 5.38 | 5.28 | 5.32 | 5.34 |
| 2 | Kinematic Viscosity at 40 C | ASTM D445 | Cst | 30.51 | 30.69 | 27.41 | 29.23 | 28.63 | 29.21 | 29.63 | 30.17 | 30.55 | 30.11 | 30.68 |
| 3 | Viscosity Index | | | 110.5 | 110.4 | 111.4 | 112.2 | 115.0 | 117.5 | 114.5 | 113.1 | 104.1 | 109.3 | 107.2 |
| 4 | Total Cycloparaffins | SFC | % | 77.80 | 78.20 | 77.80 | 77.70 | 74.20 | 77.10 | 78.50 | 79.62 | 79.00 | 77.10 | 80.90 |
| 5 | Sats X 0 (1 Ring CP) | SFC | % | 48.42 | 47.54 | 45.47 | 44.89 | 38.50 | 40.61 | 40.61 | 40.55 | 37.99 | 37.11 | 40.19 |
| 6 | Sats X -2 (2 Ring CP) | SFC | % | 21.15 | 21.62 | 24.06 | 24.24 | 24.65 | 25.44 | 26.46 | 27.38 | 26.86 | 27.45 | 27.68 |
| 7 | Sats X -4 (3 Ring CP) | SFC | % | 4.74 | 5.22 | 5.72 | 5.88 | 7.79 | 8.09 | 8.37 | 8.76 | 10.02 | 9.25 | 9.38 |
| 8 | Sats X -6 (4 Ring CP) | SFC | % | 1.45 | 1.60 | 1.35 | 1.43 | 2.06 | 1.98 | 2.08 | 2.08 | 2.76 | 2.21 | 2.39 |
| 9 | Sats X -8 (5 Ring CP) | SFC | % | 1.25 | 1.28 | 0.82 | 0.82 | 0.81 | 0.69 | 0.75 | 0.69 | 1.10 | 0.87 | 0.99 |
| 10 | Sats X -10 (6 Ring CP) | SFC | % | 0.79 | 0.75 | 0.38 | 0.43 | 0.39 | 0.29 | 0.22 | 0.20 | 0.27 | 0.31 | 0.26 |
| 11 | Sats X 2 (iso-paraffins) | SFC | % | 22.20 | 21.80 | 22.20 | 22.30 | 25.80 | 22.90 | 21.50 | 20.38 | 21.00 | 22.90 | 19.10 |
| 12 | MM-Paraffins | SFC | % | 1.23 | 1.26 | 1.17 | 0.60 | 1.79 | 1.50 | 1.43 | 1.30 | 1.91 | 1.60 | 1.57 |
| 13 | DM-Paraffins | SFC | % | 20.97 | 20.54 | 21.03 | 21.70 | 24.01 | 21.40 | 20.07 | 19.38 | 19.09 | 21.30 | 17.53 |
| 14 | Cycloparaffin Performance Ratio | SFC | | 1.3 | 1.3 | 1.3 | 1.2 | 1.0 | 1.0 | 1.0 | 0.9 | 0.8 | 0.8 | 1.0 |
| 15 | 2>R cycloparaffins | SFC | % | 29.35 | 30.66 | 32.33 | 33.61 | 35.70 | 36.49 | 37.80 | 39.12 | 41.01 | 39.99 | 40.71 |
| 16 | 3+ R cycloparaffins | SFC | % | 6.23 | 8.85 | 6.36 | 8.57 | 11.04 | 11.08 | 11.43 | 11.74 | 14.15 | 12.54 | 13.02 |
| 17 | 4+ R cycloparaffins | SFC | % | 3.49 | 3.63 | 2.55 | 2.69 | 3.26 | 2.96 | 3.06 | 2.98 | 4.13 | 3.30 | 3.64 |
| 18 | % epsilon | 13C NMR | % | 10.69 | 11.23 | 11.15 | 10.96 | 12.11 | 12.74 | 12.67 | 12.07 | 9.06 | 9.63 | 12.49 |
| 19 | % T/P Pr | 13C NMR | % | 1.19 | 1.10 | 1.25 | 1.12 | 1.08 | 1.03 | 1.10 | 1.04 | 1.19 | 0.99 | 1.19 |
| 20 | % alpha | 13C NMR | % | 3.20 | 3.21 | 3.20 | 3.04 | 3.30 | 3.22 | 3.34 | 3.17 | 2.65 | 2.92 | 3.44 |
| 21 | % P/T Et | 13C NMR | % | 1.57 | 1.64 | 1.38 | 1.40 | 1.22 | 1.22 | 1.18 | 1.11 | 1.49 | 1.65 | 1.09 |

FIG. 4

| | | | | Examples of inventive base stocks | | | | Conventional Group II High Viscosity Basestocks | | | | | | | |
|---|---|---|---|---|---|---|---|---|---|---|---|---|---|---|---|
| 1 | Kinematic Viscosity at 100 C | ASTM D445 | cSt | 11.97 | 11.97 | 10.58 | 10.88 | 10.23 | 10.42 | 10.48 | 10.83 | 10.45 | 12.11 | 12.23 | 11.97 | 10.48 |
| 2 | Kinematic Viscosity at 40 C | ASTM D445 | Cst | 106.38 | 102.62 | 83.88 | 86.36 | 80.29 | 90.18 | 91.51 | 96.42 | 98.50 | 102.18 | 104.90 | 102.90 | 89.15 |
| 3 | Viscosity Index | | | 107.7 | 106.3 | 109.5 | 111.5 | 109.6 | 96.9 | 96.8 | 94.7 | 97.0 | 109.3 | 107.5 | 99.6 | 99.0 |
| 4 | Pour Point | | deg C | | | -33 | -30 | -36 | -33.5 | -30 | -23 | -36.5 | | | | |
| 4 | Total Cycloparaffins | GCMS | % | 79.20 | 79.70 | 73.80 | 74.90 | 72.70 | 80.80 | 80.60 | 80.60 | 80.60 | 76.03 | 80.93 | 82.73 | 81.10 |
| 5 | Sats X-0 (1 Ring CP) | GCMS | % | 41.60 | 41.10 | 39.70 | 39.70 | 39.90 | 39.40 | 39.10 | 34.10 | 39.60 | 36.07 | 38.67 | 37.06 | 35.06 |
| 6 | Sats X-2 (2 Ring CP) | GCMS | % | 20.90 | 21.40 | 23.30 | 23.70 | 24.30 | 29.70 | 29.80 | 29.90 | 29.50 | 28.49 | 30.53 | 31.22 | 30.12 |
| 7 | Sats X-4 (3 Ring CP) | GCMS | % | 4.80 | 5.10 | 5.20 | 5.80 | 5.90 | 11.60 | 10.90 | 11.20 | 10.70 | 7.91 | 8.48 | 10.17 | 10.81 |
| 8 | Sats X-6 (4 Ring CP) | GCMS | % | 1.90 | 1.70 | 1.70 | 1.90 | 1.70 | 3.10 | 3.10 | 1.90 | 3.10 | 1.95 | 2.01 | 2.76 | 3.00 |
| 9 | Sats X-8 (5 Ring CP) | GCMS | % | 0.80 | 0.80 | 0.70 | 0.70 | 0.70 | 1.20 | 1.20 | 1.30 | 1.20 | 0.62 | 0.65 | 1.04 | 1.26 |
| 10 | Sats X-10 (6 Ring CP) | GCMS | % | 0.00 | 0.00 | 0.40 | 0.40 | 0.40 | 0.00 | 0.50 | 0.50 | 0.50 | 0.28 | 0.28 | 0.67 | 0.47 |
| 11 | Sats X-2 (iso-paraffins) | GCMS | % | 29.90 | 29.30 | 26.13 | 25.08 | 27.23 | 19.11 | 19.27 | 19.66 | 19.29 | 23.97 | 19.17 | 17.27 | 18.90 |
| 12 | n-paraffins | GCMS | % | 0.00 | 0.10 | 0.10 | 0.00 | 0.00 | 0.00 | 0.00 | 0.00 | 0.00 | 0.00 | 0.00 | 0.00 | 0.00 |
| 13 | MNR-Paraffins | GCMS | % | 9.90 | 9.52 | 9.89 | 9.40 | 9.40 | 9.90 | 9.70 | 9.98 | 9.96 | 9.39 | 9.46 | 9.52 | 9.52 |
| 13 | DNR-Paraffins | GCMS | % | 29.90 | 28.80 | 29.78 | 29.68 | 29.78 | 18.39 | 18.66 | 18.72 | 18.53 | 23.58 | 18.39 | 16.95 | 18.39 |
| 14 | Cycloparaffin Performance Ratios | GCMS | | 3.5 | 3.4 | 3.5 | 3.4 | 3.5 | 3.6 | 3.6 | 3.6 | 3.6 | 3.2 | 3.7 | 3.6 | 3.0 |
| 15 | 2-R cycloparaffins | GCMS | % | 38.50 | 39.60 | 34.20 | 35.20 | 33.20 | 45.40 | 45.50 | 46.20 | 45.90 | 39.58 | 43.95 | 45.67 | 45.78 |
| 16 | 3-R cycloparaffins | GCMS | % | 7.90 | 8.20 | 9.60 | 9.30 | 8.70 | 15.70 | 15.70 | 16.10 | 15.50 | 10.78 | 12.41 | 14.49 | 15.81 |
| 17 | 4+ R cycloparaffins | GCMS | % | 3.00 | 3.10 | 2.80 | 2.90 | 2.80 | 4.70 | 4.60 | 5.10 | 4.60 | 2.86 | 2.93 | 4.77 | 4.81 |
| 18 | % epsilon | $^{13}$C NMR | % | 13.32 | 14.04 | 13.56 | 14.71 | 13.07 | 11.58 | 12.03 | 10.87 | 12.13 | 12.49 | 13.60 | 12.55 | 11.80 |
| 19 | % T/P th | $^{13}$C NMR | % | 0.89 | 0.85 | 0.89 | 0.98 | 0.96 | 0.90 | 0.93 | 0.94 | 0.91 | 0.99 | 0.80 | 0.76 | 1.25 |
| 20 | % alpha | $^{13}$C NMR | % | 2.82 | 2.97 | 2.85 | 2.91 | 2.98 | 2.93 | 2.71 | 2.75 | 2.92 | 2.77 | 2.61 | 2.74 | 2.74 |
| 21 | % P/T Et | $^{13}$C NMR | % | 1.32 | 1.21 | 1.20 | 1.05 | 1.17 | 1.04 | 0.96 | 0.98 | 0.92 | 1.04 | 1.09 | 0.98 | 1.40 |

FIG. 5

LUBRICANT BASESTOCK PRODUCTION WITH ENHANCED AROMATIC SATURATION

CROSS-REFERENCE TO RELATED APPLICATIONS

This application claims priority to U.S. Provisional Application Ser. No. 62/315,808 filed Mar. 31, 2016 and U.S. Provisional Application Ser. No. 62/356,749 filed Jun. 30, 2016, which are both herein incorporated by reference in their entirety.

FIELD

Systems and methods are provided for production of lubricant boiling range products.

BACKGROUND

Many refineries include thermal cracking processes as part of an overall process flow for handling challenged feeds. Thermal cracking processes have traditionally been effective for producing naphtha fractions suitable for use in motor gasoline products, but effective production of high quality distillate fuel products has remained a challenge.

U.S. Patent Application Publication 2011/0315596 describes an integrated process for hydrocracking and dewaxing of hydrocarbons to form naphtha, diesel, and/or lubricant base stock boiling range products. The integrated process includes dewaxing and optionally hydrocracking under sour conditions, a separation to form a first diesel product and a bottoms product, and additional hydrocracking and dewaxing to form a second diesel product and optionally a lubricant base oil product. The hydrocracking and dewaxing catalysts can include base metals or can include Pd and/or Pt. An example of a hydrocracking catalyst is USY and an example of a dewaxing catalyst is ZSM-48.

U.S. Pat. No. 8,932,454 describes a method of making and using a Y zeolite hydrocracking catalyst. The Y zeolite catalyst has a small mesoporous peak in the pore size distribution of around 40 Å as measured by nitrogen desorption.

U.S. Pat. No. 8,778,171 describes a method of making and using a Y zeolite hydrocracking catalyst. The Y zeolite catalyst contains stabilized aggregates of Y zeolite primary crystallites having a size of 0.5 microns or less.

U.S. Patent Application Publication 2013/0341243 describes a hydrocracking process selective for improved distillate and improved lube yield and properties. A two-stage hydrocracking catalyst can be used for hydrocracking of a feed to form a converted portion suitable for diesel fuel production and an unconverted portion suitable for production of lubricant base stocks. The two-stage hydrocracking catalyst can correspond to a first stage catalyst including Pd and/or Pt supported on USY and a second stage catalyst including Pd and/or Pt supported on ZSM-48.

SUMMARY

In an aspect, a method for producing a lubricant boiling range product is provided. The method can include hydroprocessing a feedstock comprising a 650° F. (~343° C.) portion under first hydroprocessing conditions to form a hydroprocessed effluent. At least a portion of the hydroprocessed effluent can be fractionated to form at least a first fuels boiling range fraction and a second fraction, the second fraction comprising a lubricant boiling range portion. The second fraction can be hydrocracked in the presence of hydrocracking catalyst under hydrocracking conditions to form a hydrocracked effluent. Optionally, the hydrocracking catalyst can comprise USY zeolite having a unit cell size of 24.30 Å or less and/or a silica to alumina ratio of at least 50 and/or an Alpha value of 20 or less. Optionallly, the hydrocracking catalyst can further comprise 0.1 wt % to 5.0 wt % of a Group 8-10 noble metal supported on the hydrocracking catalyst. The hydrocracking conditions can include a hydrocracking reactor exit temperature. At least a portion of the hydrocracked effluent and a recycled portion of a dewaxed effluent can be dewaxed under catalytic dewaxing conditions to form a dewaxed effluent. The recycled portion of the dewaxed effluent can optionally comprise 20 wt % to 50 wt % of the dewaxed effluent. The catalytic dewaxing conditions can comprise a dewaxing reactor inlet temperature that is at least 20° C. lower than the hydrocracking reactor exit temperature. At least a portion of the dewaxed effluent can be separated to form at least the recycled portion of the dewaxed effluent and a product portion of the dewaxed effluent. The product portion of the dewaxed effluent can be fractionated to form at least a fuels boiling range product and a lubricant boiling range product, wherein the lubricant boiling range product optionally has an aromatics content of 2.0 wt % or less.

In an aspect, a system for producing a lubricant boiling range product is provided. The system can include a hydrotreating reactor comprising a hydrotreating feed inlet, a hydrotreating effluent outlet, and at least one fixed catalyst bed comprising a hydrotreating catalyst. The system can further include a separation stage having a first separation stage inlet and a second separation stage inlet, the first separation stage inlet being in fluid communication with the hydrotreating effluent outlet. The separation stage can further comprise a plurality of separation stage liquid effluent outlets, with one or more of the separation stage liquid effluent outlets optionally corresponding to product outlets. The system can further include a hydrocracking reactor comprising a hydrocracking feed inlet, a hydrocracking effluent outlet, and at least one fixed catalyst bed comprising a hydrocracking catalyst. The hydrocracking feed inlet can be in fluid communication with at least one separation stage liquid effluent outlet. The hydrocracking catalyst can comprise USY zeolite having a unit cell size of 24.30 Å or less and/or a silica to alumina ratio of at least 50 and/or an Alpha value of 20 or less. The hydrocracking catalyst can further comprise 0.1 wt % to 5.0 wt % of a Group 8-10 noble metal supported on the hydrocracking catalyst. The system can further include a dewaxing reactor comprising a dewaxing feed inlet, a dewaxing effluent outlet, and at least one fixed catalyst bed comprising a dewaxing catalyst. The dewaxing feed inlet can be in fluid communication with the hydrocracking effluent outlet and/or can be in fluid communication with the dewaxing effluent outlet.

BRIEF DESCRIPTION OF THE DRAWINGS

FIG. 4 shows the composition of exemplary low viscosity base stocks of this disclosure compared with the composition of reference low viscosity base stocks.

FIG. 5 shows the composition of exemplary high viscosity base stocks of this disclosure compared with the composition of reference high viscosity base stocks.

DETAILED DESCRIPTION

Overview

Figure 1:
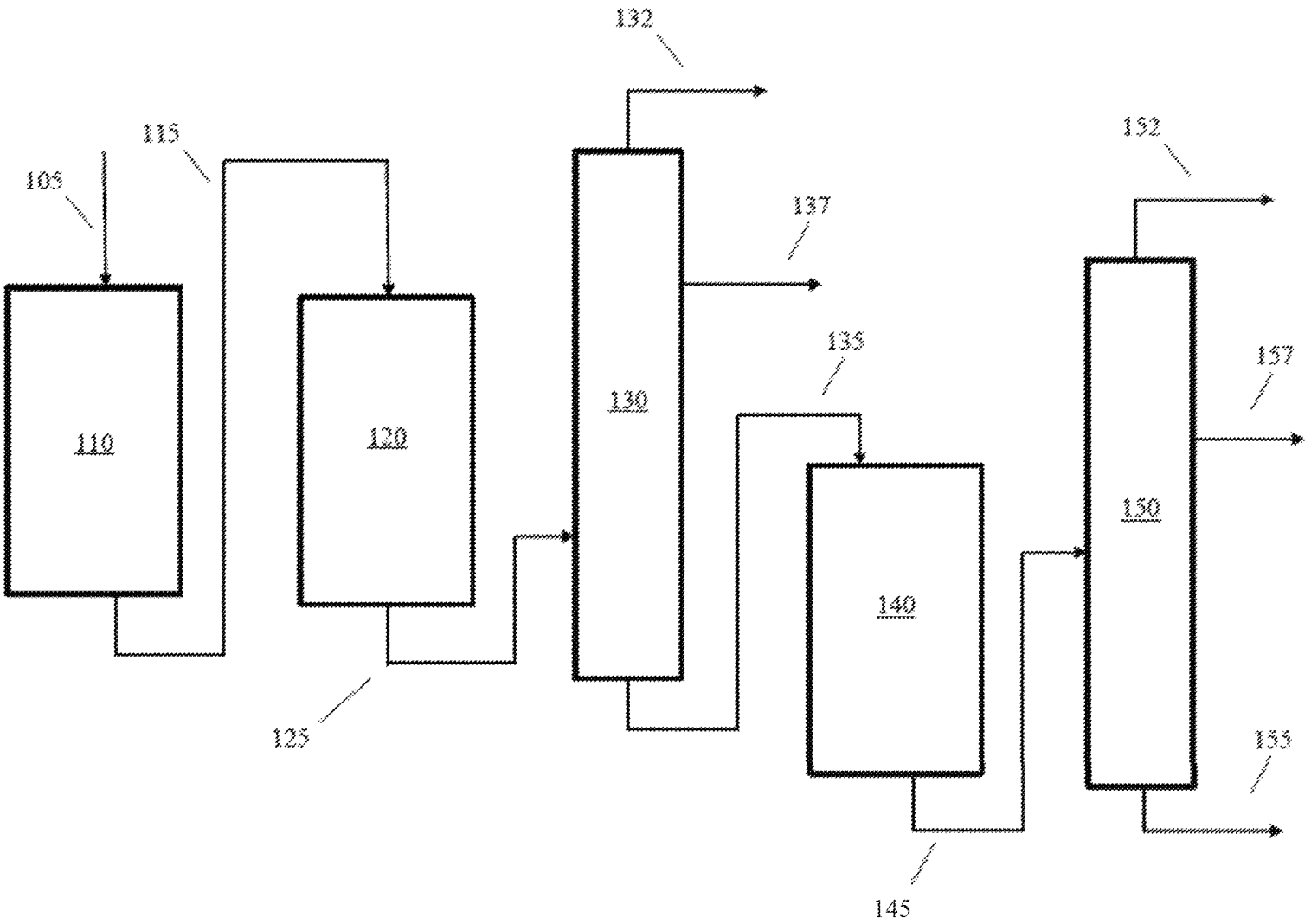
FIG. 1 schematically shows an example of a configuration suitable for processing a feedstock to form at least a lubricant boiling range fraction.

All numerical values within the detailed description and the claims herein are modified by "about" or "approximately" the indicated value, and take into account experimental error and variations that would be expected by a person having ordinary skill in the art.

In various aspects, systems and methods are provided for producing lubricant basestocks having a reduced or minimized aromatics content. A first processing stage can perform an initial amount of hydrotreating and/or hydrocracking. A first separation stage can then be used to remove fuels boiling range (and lower boiling range) compounds. The remaining lubricant boiling range fraction can then be exposed under hydrocracking conditions to a USY catalyst including a supported noble metal, such as Pt and/or Pd. The USY catalyst can have a desirable combination of catalyst properties, such as a unit cell size of 24.30 or less (or 24.24 or less), a silica to alumina ratio of at least 50 (or at least 80), and an alpha value of 20 or less (or 10 or less). In some aspects, the effluent from the second (hydrocracking) stage can be dewaxed without further separation. In such aspects, a portion of the dewaxed effluent can be used as a recycle quench stream to cool the hydrocracking effluent prior to entering the dewaxing reactor. The combination of hydrocracking in the presence of the USY catalyst and using a quench stream prior to the dewaxing reactor can allow for production of lubricant boiling range products having a reduced or minimized content of aromatics, such as 1.5 wt % or less, or 1.0 wt % or less.

In various aspects, use of a recycle quench stream can allow the effluent from a USY hydrocracking reactor to be passed into a dewaxing reactor without intermediate separation while also allowing for greater relative control of various temperatures. For example, the temperature of the hydrocracked effluent at the inlet to the dewaxing reactor can be at least 10° F. (~5° C.) cooler than the temperature of the input feed to the USY hydrocracking reactor, or at least 20° F. (~10° C.) cooler, such as up to 40° F. (~20° C.) cooler or more. Additionally or alternately, the temperature of the hydrocracked effluent at the inlet to the dewaxing reactor can be at least 40° F. (~20° C.) cooler than the temperature of the hydrocracked effluent at the exit from the USY hydrocracking reactor, or at least 50° F. (~25° C.), or at least 60° F. (~30° C.), such as up to 80° F. (~40° C.) or more. In order to cool the hydrocracked effluent, 20 wt % to 50 wt % of the dewaxed effluent can be recycled to a location prior to the inlet to the dewaxing reactor. The location for withdrawing the dewaxed effluent for recycle can be any convenient location after the dewaxing reactor and prior to fractionation of the dewaxed effluent. For example, if the dewaxing reactor includes a hydrofinishing catalyst and/or if the dewaxed effluent is passed into a separate hydrofinishing reactor prior to fractionation, the dewaxed effluent used for the recycle stream can correspond to a recycled portion of a dewaxed and hydrofinished effluent. In some aspects, the weight average bed temperature of the dewaxing reactor can be greater than the dewaxing reactor inlet temperature by 15° C. or less, or by 10° C. or less.

FIG. 1 shows an example of a general processing configuration suitable for processing a feedstock to produce distillate fuels. In FIG. 1, a feedstock 105 can be introduced into a first reactor 110. A reactor such as first reactor 110 can include a feed inlet and an effluent outlet. First reactor 110 can correspond to a hydrotreating reactor, a hydrocracking reactor, or a combination thereof. Optionally, a plurality of reactors can be used to allow for selection of different conditions. For example, if both a first reactor 110 and optional second reactor 120 are included in the reaction system, first reactor 110 can correspond to a hydrotreatment reactor while second reactor 120 can correspond to a hydrocracking reactor. In some embodiments, effluent 115 passes from first reactor 110 to optional second reactor 120. Yet other options for arranging reactor(s) and/or catalysts within the reactor(s) to perform initial hydrotreating and/or hydrocracking of a feedstock can also be used. Optionally, if a configuration includes multiple reactors in the initial stage, a gas-liquid separation can be performed between reactors to allow for removal of light ends and contaminant gases. In aspects where the initial stage includes a hydrocracking reactor, the hydrocracking reactor in the initial stage can be referred to as an additional hydrocracking reactor.

The hydroprocessed effluent 125 from the final reactor (such as reactor 120) of the initial stage can then be passed into a fractionator 130, or another type of separation stage. Fractionator 130 (or other separation stage) can separate the hydroprocessed effluent to form one or more fuel boiling range fractions 137, a light ends fraction 132, and a lubricant boiling range fraction 135. The lubricant boiling range fraction 135 can often correspond to a bottoms fraction from the fractionator 130. The lubricant boiling range fraction 135 can undergo further hydrocracking in the presence of a USY zeolite in second stage reactor 140. In the configuration shown in FIG. 1, the effluent 145 from second stage reactor 140 can be fractionated 150 to separate out light ends 152 and/or fuel boiling range fraction(s) 157 prior to further processing of lubricant boiling range fraction 155, such as further dewaxing and/or hydrofinishing.

The configuration in FIG. 1 can allow the second stage reactor 140 to be operated under sweet processing conditions, corresponding to the equivalent of a feed (to the second stage) sulfur content of 100 wppm or less. Under such "sweet" processing conditions, the configuration in FIG. 1, in combination with use of the USY catalyst, can allow for production of a hydrocracked effluent having a reduced or minimized content of aromatics.

In the configuration shown in FIG. 1, the final reactor in (such as reactor 120) in the initial stage can be referred to as being in direct fluid communication with an inlet to the fractionator 130 (or an inlet to another type of separation stage). The other reactors in the initial stage can be referred to as being in indirect fluid communication with the inlet to the separation stage, based on the indirect fluid communication provided by the final reactor in the initial stage. The reactors in the initial stage can generally be referred to as being in fluid communication with the separation stage, based on either direct fluid communication or indirect fluid communication.

Figure 2:
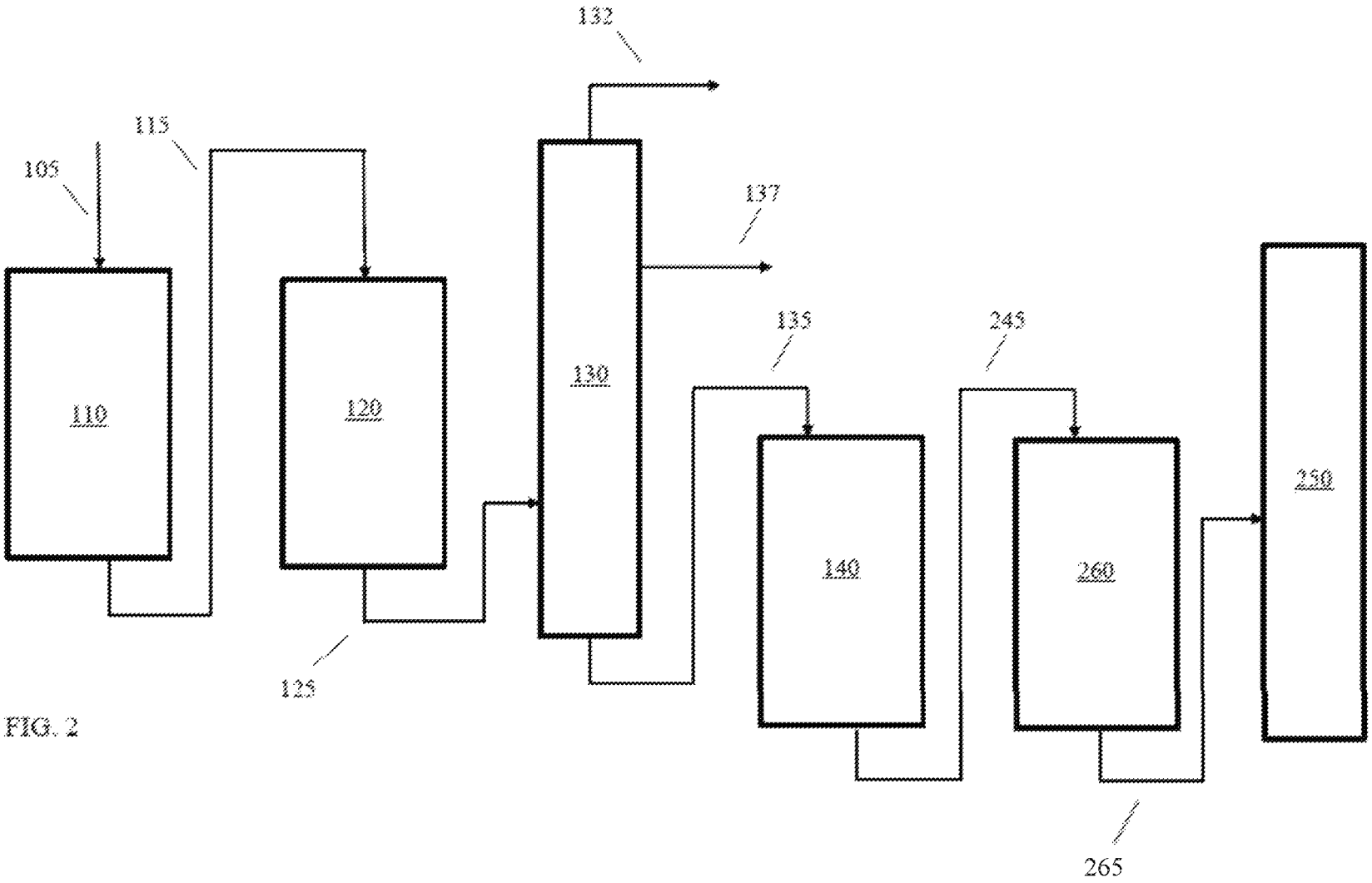
FIG. 2 schematically shows another example of a configuration suitable for processing a feedstock to form at least a lubricant boiling range fraction.

Because second stage reactor 140 is operating under sweet operating conditions, it can be beneficial to avoid having a separation stage 150 between second stage reactor 140 and a subsequent reactor containing a dewaxing catalyst. FIG. 2 shows an example of a reaction configuration where separation stage 250 is located after additional dewaxing and/or hydrofinishing reactor 260. In some embodiments, effluent 265 passes from the additional dewaxing and/or hydrofinishing reactor 260 to a separation stage 250. The configuration in FIG. 2 can be suitable for production of lubricant base stocks with unexpected compositional properties, as described in Example 1 below.

In some limited situations, one potential difficulty with passing the effluent 245 into additional reactor 260 without an additional separation is that the desired operating temperature for dewaxing in additional reactor 260 can be substantially lower than the exit temperature of reactor 140. One option for reducing the temperature of effluent 245 can be to use make-up hydrogen or another high pressure gas stream as a quench gas. However, due to the limited heat capacity of a gas a quench gas can provide only a limited amount of cooling for effluent 245. As a result, a configuration similar to FIG. 2 can lead to effluent 245 being at a temperature above the desired operating temperature for the dewaxing reaction in additional reactor 260.

Figure 3:
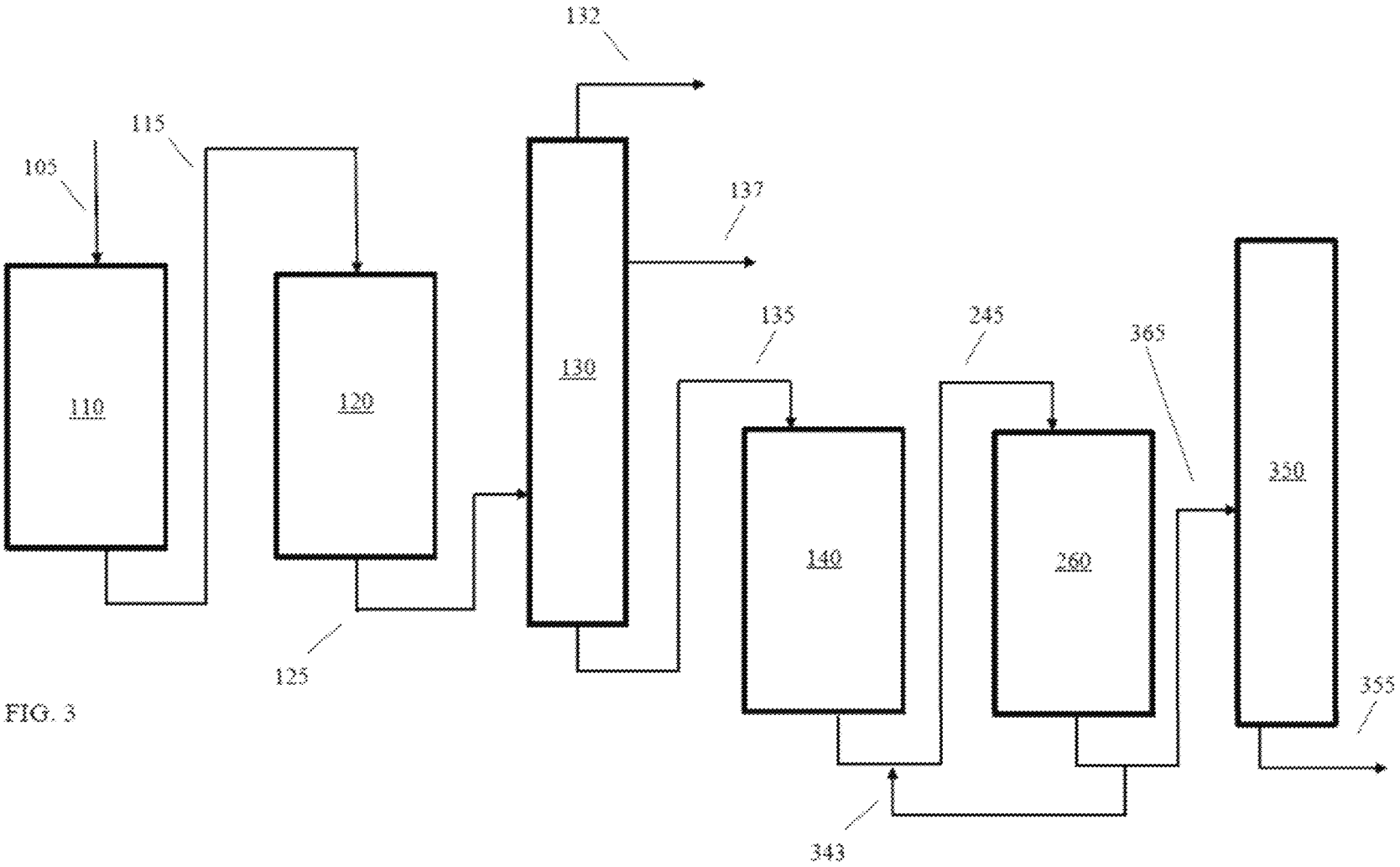
FIG. 3 schematically shows another example of a configuration suitable for processing a feedstock to form at least a lubricant boiling range fraction.

In various aspects, a configuration similar to FIG. 3 can be used to allow for improved aromatic saturation during dewaxing and/or hydrofinishing. A portion 343 of the dewaxed effluent 365 from additional reactor 260 can be recycled and used as a quench fluid for effluent 245. This can allow for further reduction of the temperature of effluent 145 prior to entering additional reactor 260, so that the input temperature of effluent 145 can match the desired inlet temperature for additional reactor 260.

Use of liquid recycle can potentially provide a variety of additional benefits. One benefit can be additional aromatic saturation of the feed, as a portion 343 of the dewaxed effluent 365 passes through additional reactor 260 at least an additional time. This can result in a lubricant boiling range fraction 355 with an unexpectedly low aromatics content. Additionally or alternately, use of a portion 343 of dewaxed effluent 365 as a liquid recycle stream for quenching can reduce or minimize the need for high pressure quench gas, which can reduce processing costs.

In this discussion, the naphtha boiling range is defined as 50° F. (~10° C., roughly corresponding to the lowest boiling point of a pentane isomer) to 315° F. (157° C.). The jet boiling range is defined as 315° F. (157° C.) to 460° F. (238° C.). The diesel boiling range is defined as 460° F. (238° C.) to 650° F. (343° C.). The distillate fuel boiling range (jet plus diesel), is defined as 315° F. (157° C.) to 650° F. (343° C.). The fuels boiling range is defined as ~10° C. to 343° C. The lubricant boiling range is defined as 650° F. (343° C.) to 1050° F. (566° C.). Optionally, when forming a lubricant boiling portion by fractionation after one or more stages of hydroprocessing (e.g., hydrotreating, hydrocracking, catalytic dewaxing, hydrofinishing), a lubricant boiling range portion can optionally correspond to a bottoms fraction, so that higher boiling range compounds may also be included in the lubricant boiling range portion. Compounds ($C_{4-}$) with a boiling point below the naphtha boiling range can be referred to as light ends. It is noted that due to practical consideration during fractionation (or other boiling point based separation) of hydrocarbon-like fractions, a fuel fraction formed according to the methods described herein may have T5 and T95 distillation points corresponding to the above values (or T10 and T90 distillation points), as opposed to having initial/final boiling points corresponding to the above values.

In this discussion, unless otherwise specified, references to a liquid effluent or a liquid product are references to an effluent or product that is a liquid at 25° C. and 100 kPa-a (~1 atm).

In this discussion, conditions may be provided for various types of hydroprocessing of feeds or effluents. Examples of hydroprocessing can include, but are not limited to, one or more of hydrotreating, hydrocracking, catalytic dewaxing, and hydrofinishing/aromatic saturation. Such hydroprocessing conditions can be controlled to have desired values for the conditions (e.g., temperature, pressure, LHSV, treat gas rate) by using at least one controller, such as a plurality of controllers, to control one or more of the hydroprocessing conditions. In some aspects, for a given type of hydroprocessing, at least one controller can be associated with each type of hydroprocessing condition. In some aspects, one or more of the hydroprocessing conditions can be controlled by an associated controller. Examples of structures that can be controlled by a controller can include, but are not limited to, valves that control a flow rate, a pressure, or a combination thereof; heat exchangers and/or heaters that control a temperature; and one or more flow meters and one or more associated valves that control relative flow rates of at least two flows. Such controllers can optionally include a controller feedback loop including at least a processor, a detector for detecting a value of a control variable (e.g., temperature, pressure, flow rate, and a processor output for controlling the value of a manipulated variable (e.g., changing the position of a valve, increasing or decreasing the duty cycle and/or temperature for a heater). Optionally, at least one hydroprocessing condition for a given type of hydroprocessing may not have an associated controller.

Group I basestocks or base oils are defined as base oils with less than 90 wt % saturated molecules and/or at least 0.03 wt % sulfur content. Group I basestocks also have a viscosity index (VI) of at least 80 but less than 120. Group II basestocks or base oils contain at least 90 wt % saturated molecules and less than 0.03 wt % sulfur. Group II basestocks also have a viscosity index of at least 80 but less than 120. Group III basestocks or base oils contain at least 90 wt % saturated molecules and less than 0.03 wt % sulfur, with a viscosity index of at least 120. In addition to the above formal definitions, some Group I basestocks may be referred to as a Group I+ basestock, which corresponds to a Group I basestock with a VI value of 103 to 108. Some Group II basestocks may be referred to as a Group II+ basestock, which corresponds to a Group II basestock with a VI of at least 113. Some Group III basestocks may be referred to as a Group III+ basestock, which corresponds to a Group III basestock with a VI value of at least 140.

Feedstocks

A wide range of petroleum and chemical feedstocks can be hydroprocessed in accordance with the invention. Suitable feedstocks include whole and reduced petroleum crudes, atmospheric, cycle oils, gas oils, including vacuum gas oils and coker gas oils, light to heavy distillates including raw virgin distillates, hydrocrackates, hydrotreated oils, slack waxes, Fischer-Tropsch waxes, raffinates, and mixtures of these materials.

One way of defining a feedstock is based on the boiling range of the feed. One option for defining a boiling range is to use an initial boiling point for a feed and/or a final boiling point for a feed. Another option is to characterize a feed based on the amount of the feed that boils at one or more temperatures. For example, a "T5" boiling point/distillation point for a feed is defined as the temperature at which 5 wt % of the feed will boil off. Similarly, a "T95" boiling point/distillation point is a temperature at 95 wt % of the feed will boil. Boiling points, including fractional weight boiling points, can be determined using a suitable ASTM method, such as ASTM D2887.

Typical feeds include, for example, feeds with an initial boiling point and/or a T5 boiling point and/or T10 boiling point of at least 600° F. (~316° C.), or at least 650° F. (~343° C.), or at least 700° F. (371° C.), or at least 750° F. (~399° C.). Additionally or alternately, the final boiling point and/or T95 boiling point and/or T90 boiling point of the feed can be 1100° F. (~593° C.) or less, or 1050° F. (~566° C.) or less, or 1000° F. (~538° C.) or less, or 950° F. (~510° C.) or less. In particular, a feed can have a T5 to T95 boiling range of 600° F. (~316° C.) to 1100° F. (~593° C.), or a T5 to T95 boiling range of 650° F. (~343° C.) to 1050° F. (~566° C.), or a T10 to T90 boiling range of 650° F. (~343° C.) to 1050° F. (~566° C.) Optionally, if the hydroprocessing is also used to form fuels, it can be possible to use a feed that includes a lower boiling range portion. Such a feed can have an initial boiling point and/or a T5 boiling point and/or T10 boiling point of at least 350° F. (~177° C.), or at least 400° F. (~204° C.), or at least 450° F. (~232° C.). In particular, such a feed can have a T5 to T95 boiling range of 350° F. (~177° C.) to 1100° F. (~593° C.), or a T5 to T95 boiling range of 450° F. (~232° C.) to 1050° F. (~566° C.), or a T10 to T90 boiling range of 350° F. (~177° C.) to 1050° F. (~566° C.).

In some embodiments, the feedstock to the hydroprocessing step has a solvent dewaxed viscosity index of 20 to 45.

In some aspects, the aromatics content of the feed can be at least 20 wt %, or at least 30 wt %, or at least 40 wt %, or at least 50 wt %, or at least 60 wt %. In particular, the aromatics content can be 20 wt % to 90 wt %, or 40 wt % to 80 wt %, or 50 wt % to 80 wt %.

In aspects where the hydroprocessing includes a hydrotreatment process and/or a sour hydrocracking process, the feed can have a sulfur content of 500 wppm to 20000 wppm or more, or 500 wppm to 10000 wppm, or 500 wppm to 5000 wppm. Additionally or alternately, the nitrogen content of such a feed can be 20 wppm to 4000 wppm, or 50 wppm to 2000 wppm. In some aspects, the feed can correspond to a "sweet" feed, so that the sulfur content of the feed is 10 wppm to 500 wppm and/or the nitrogen content is 1 wppm to 100 wppm.

In some embodiments, at least a portion of the feed can correspond to a feed derived from a biocomponent source. In this discussion, a biocomponent feedstock refers to a hydrocarbon feedstock derived from a biological raw material component, from biocomponent sources such as vegetable, animal, fish, and/or algae. Note that, for the purposes of this document, vegetable fats/oils refer generally to any plant based material, and can include fat/oils derived from a source such as plants of the genus Jatropha. Generally, the biocomponent sources can include vegetable fats/oils, animal fats/oils, fish oils, pyrolysis oils, and algae lipids/oils, as well as components of such materials, and in some embodiments can specifically include one or more type of lipid compounds. Lipid compounds are typically biological compounds that are insoluble in water, but soluble in nonpolar (or fat) solvents. Non-limiting examples of such solvents include alcohols, ethers, chloroform, alkyl acetates, benzene, and combinations thereof.

Second Stage Hydrocracking with USY Catalyst

In various aspects, the second stage for processing of a feedstock can correspond to exposing at least a portion of the feedstock to a USY catalyst with a desirable combination of properties. The properties can be measured prior to the addition of loaded metals on the catalyst. The USY catalyst can have a unit cell size of 24.30 Å or less, or 24.27 Å or less, or 24.24 Å or less. Additionally or alternately, the USY catalyst can have a silica to alumina ratio of at least 50, or at least 70, or at least 90, or at least 100, or at least 110, or at least 120, or at least 125, and optionally up to 250 or more, or not more than 1000. This level of silica to alumina ratio can correspond to a "dealuminated" version of the catalyst. Additionally or alternately, the USY catalyst can have an alpha value of 20 or less, or 10 or less. The alpha value test is a measure of the cracking activity of a catalyst and is described in U.S. Pat. No. 3,354,078 and in the *Journal of Catalysis*, Vol. 4, p. 527 (1965); Vol. 6, p. 278 (1966); and Vol. 61, p. 395 (1980), each incorporated herein by reference as to that description. The experimental conditions of the test used herein include a constant temperature of 538° C. and a variable flow rate as described in detail in the *Journal of Catalysis,* Vol. 61, p. 395.

Process conditions in a catalytic dewaxing zone can include a temperature of from 200 to 450° C., preferably 270 to 400° C., a hydrogen partial pressure of from 1.8 to 34.6 MPag (~250 to ~5000 psi), preferably 4.8 to 20.8 MPag, a liquid hourly space velocity of from 0.2 to 10 $hu^{-1}$, preferably 0.5 to 3.0 $hr^{-1}$, and a hydrogen circulation rate of from 35.6 to 1781 $m^3/m^3$ (~200 to ~10,000 SCF/B), preferably 178 to 890.6 $m^3/m^3$ (~1000 to ~5000 scf/B). Additionally or alternately, the conditions can include temperatures in the range of 600° F. (~343° C.) to 815° F. (~435° C.), hydrogen partial pressures of from 500 psig to 3000 psig (~3.5 MPag to ~20.9 MPag), and hydrogen treat gas rates of from 213 $m^3/m^3$ to 1068 $m^3/m^3$ (~1200 SCF/B to ~6000 SCF/B).

A USY hydrocracking catalyst can also include a binder material. Suitable binder materials include materials selected from metal oxides, zeolites, aluminum phosphates, polymers, carbons, and clays. Most preferable, the binder is comprised of at least one metal oxide, preferably selected from silica, alumina, silica-alumina, amorphous aluminosilicates, boron, titania, and zirconia. Preferably, the binder is selected from silica, alumina, and silica-alumina. In a preferred embodiment, the binder is comprised of pseudoboehmite alumina.

A catalyst can contain from 0 to 99 wt % binder materials, or 25 to 80 wt %, or 35 to 75 wt %, or 50 to 65 wt % of the overall final hydrocracking catalyst. In other preferred embodiments, a hydrocracking catalyst can be less than 80 wt % binder materials, or less than 75 wt %, or less than 65 wt %, or less than 50 wt %.

A hydrocracking catalyst containing USY zeolite may also contain additional zeolites or molecular sieves. In some aspects, a hydrocracking catalyst can further comprise at least one of the following molecular sieves: beta, ZSM-5, ZSM-11, ZSM-57, MCM-22, MCM-49, MCM-56, ITQ-7, ITQ-27, ZSM-48, mordenite, zeolite L, ferrierite, ZSM-23 MCM-68, SSZ-26/-33, SAPO-37, ZSM-12, ZSM-18, and EMT faujasites. In such aspects, the hydrocracking catalyst can contain the EMY zeolite in an amount of at least 10 wt %, more preferably at least at least 25 wt %, and even more preferably at least 35 wt % or even at least 50 wt % based on the finished catalyst, particularly when a binder is utilized.

A USY hydrocracking catalyst can also include at least one hydrogenating metal component supported on the catalyst. Examples of such hydrogenating metal components can include one or more noble metals from Groups 8-10 of the IUPAC periodic table. Optionally but preferably, the hydrocracking catalyst can include at least one Group 8/9/10 metal selected from Pt, Pd, Rh and Ru (noble metals), or combinations thereof. In an aspect, the hydrocracking catalyst can comprise at least one Group 8/9/10 metal selected from Pt, Pd, or a combination thereof. In an aspect, the hydrocracking catalyst can comprise Pt. The at least one hydrogenating metal may be incorporated into the catalyst by any technique known in the art. A preferred technique for active metal incorporation into the catalyst herein is the incipient wetness technique.

The amount of active metal in the catalyst can be at least 0.1 wt % based on catalyst, or at least 0.15 wt %, or at least 0.2 wt %, or at least 0.25 wt %, or at least 0.3 wt %, or at least 0.5 wt % based on the catalyst. For embodiments where the Group 8/9/10 metal is Pt, Pd, Rh, Ru, or a combination thereof, the amount of active metal is preferably from 0.1 to 5 wt %, more preferably from 0.2 to 4 wt %, and even more preferably from 0.25 to 3.5 wt %.

Examples of suitable zeolite Y catalysts for the processes described herein can include catalysts based on aggregated Y zeolite (or Meso-Y) and Extra Mesoporous Y ("EMY") zeolite. Additional description of aggregated Y zeolite (Meso-Y) can be found in U.S. Pat. No. 8,778,171, which is incorporated herein by reference with regard to description of aggregated Y zeolite and methods for making a catalyst containing aggregated Y zeolite. Additional description of Extra Mesoporous Y zeolite can be found in U.S. Pat. No. 8,932,454, which is incorporated herein by reference with regard to description of EMY zeolite and methods for making a catalyst containing EMY zeolite.

Briefly Meso-Y refers to a stabilized aggregated form of zeolite Y that comprises small primary crystallites and secondary particles of larger size. At least 80%, e.g., at least 90% or at least 95%, of the primary crystallites may be aggregated or clustered to form the secondary particles. The ratio of the average size (width/diameter) of the secondary particles to the average size (width/diameter) of the primary crystallites, when the outer (i.e., external) surfaces of the secondary particles are viewed, may be at least 3:1, for example at least 5:1 or at least 10:1. When the outer surfaces of the secondary particles are viewed, e.g., in an SEM image, the average size of the primary crystallites in a secondary particle may be 0.5 μm or less, for example 0.3 μm or less, 0.2 μm or less, or 0.1 μm or less, whereas the average size of the secondary particles may be 0.8 μm or more, for example 1.0 μm or more or 2.0 μor more. At least 80%, e.g., at least 90% or at least 95%, of the aggregated secondary particles may comprise at least 5, for example at least 10, primary crystallites. These primary crystallites and secondary particles as described herein may be observable, e.g., by an SEM under sufficient conditions including appropriate magnification and resolution.

The average sizes of the primary crystallites and secondary particles can be determined, for instance, by viewing one or more sufficient two-dimensional SEM images of the secondary particles and approximating the shape of the primary crystallites and secondary particles roughly as two-dimensional spherical projections (circles). When percentages (e.g., 80%, 90%, 95%, or the like) of primary crystallites and secondary particles are referred to herein, it should be understood that these percentages are based on numbers of these particles. Although SEM images referred to herein do not necessarily depict all of the particles in an entire batch of primary crystallites and secondary particles, it should also be understood that the SEM images referred to herein are viewed as representative of an entire batch of primary crystallites and secondary particles, including even those particles not specifically observed.

The secondary particles may possess an external surface area of 10 $m^2/g$ or more, for example, 20 $m^2/g$ or more or 40 $m^2/g$ or more, especially after undergoing calcination and/or steaming. Conventional forms of zeolite Y, such as those having non-aggregated primary crystallites with a size of 1 micron or more, tend to have an external surface area of less than 10 $m^2/g$. The relatively high external surface area of the secondary particles can be an indication generally of porous gaps between individual primary crystallites, and specifically of mesopores in the internal regions of the secondary particles. A single crystal of comparable size in the form of a generally spherical shape (with angularity or edges developed) would be expected to have a smaller external surface area.

Briefly, an EMY zeolite can be a Y structure zeolite with a suppressed "small mesopore peak" that is commonly found associated within the "small mesopores" (30 to 50 Å pore diameters) of commercial Y-type zeolites, while maintaining a substantial volume of pores in the "large mesopores" (greater than 50 to 500 Å pore diameters) of the zeolite. International Union of Pure and Applied Chemistry ("IUPAC") standards defines "mesopores" as having pore diameters greater than 20 to less than 500 Angstroms (Å). However, the standard nitrogen desorption measurements as used herein do not provide pore volume data below ~22 Å. Additionally, since the "small mesopore peak" found in Y zeolites are substantially confined between the 30 and 50 Å ranges, it is sufficient to define the measurable mesoporous pore diameter range for the purposes of this invention as pore diameters from 30 to 500 Angstroms (Å).

As utilized herein, the terms "Small Mesopore(s)" or "Small Mesoporous" are defined as those pore structures in the zeolite crystal with a pore diameter of 30 to 50 Angstroms (Å). Similarly, the terms "Large Mesopore(s)" or "Large Mesoporous" as utilized herein are defined as those pore structures in the zeolite crystal with a pore diameter of greater than 50 to 500 Angstroms (Å). The terms "Mesopore(s)" or "Mesoporous" when utilized herein alone (i.e., not in conjunction with a "small" or "large" adjective) are defined herein as those pore structures in the zeolite crystal with a pore diameter of 30 to 500 Angstroms (Å). Unless otherwise noted, the unit of measurement used for mesoporous pore diameters herein is in Angstroms (Å).

In various aspects, the Large-to-Small Pore Volume Ratio or "LSPVR" of an EMY zeolite can be at least 4.0, more preferably at least 5.0, and even more preferably, the LSPVR of the EMY can be at least 6.0. Additionally or alternately, the "Large-to-Small Pore Volume Ratio" of an EMY can be at least 10.0, or at least 12.0, or at least 15.0 after long-term deactivation steaming at 1400° F. for 16 hours.

EMY zeolites can have a Large Mesopore Volume of at least 0.03 $cm^3/g$, more preferably at least 0.05 $cm^3/g$, and even more preferably at least 0.07 $cm^3/g$. Additionally or alternately, EMY zeolites can have a Small Mesopore Peak of less than 0.15 $cm^3/g$, or less 0.13 $cm^3/g$, or less than 0.11 $cm^3/g$.

First Hydroprocessing Stage—Hydrotreating and/or Hydrocracking

In various aspects, a first hydroprocessing stage can be used to improve one or more qualities of a feedstock for lubricant base oil production. Examples of improvements of a feedstock can include, but are not limited to, reducing the heteroatom content of a feed, performing conversion on a feed to provide viscosity index uplift, and/or performing aromatic saturation on a feed.

With regard to heteroatom removal, the conditions in the initial hydroprocessing stage (hydrotreating and/or hydrocracking) can be sufficient to reduce the sulfur content of the hydroprocessed effluent to 250 wppm or less, or 200 wppm or less, or 150 wppm or less, or 100 wppm or less, or 50 wppm or less, or 25 wppm or less, or 10 wppm or less. In particular, the sulfur content of the hydroprocessed effluent can be 1 wppm to 250 wppm, or 1 wppm to 50 wppm, or 1 wppm to 10 wppm. Additionally or alternately, the conditions in the initial hydroprocessing stage can be sufficient to reduce the nitrogen content to 100 wppm or less, or 50 wppm or less, or 25 wppm or less, or 10 wppm or less. In particular, the nitrogen content can be 1 wppm to 100 wppm, or 1 wppm to 25 wppm, or 1 wppm to 10 wppm.

In aspects that include hydrotreating as part of the initial hydroprocessing stage, the hydrotreating catalyst can comprise any suitable hydrotreating catalyst, e.g., a catalyst comprising at least one Group 8-10 non-noble metal (for example selected from Ni, Co, and a combination thereof) and at least one Group 6 metal (for example selected from Mo, W, and a combination thereof), optionally including a suitable support and/or filler material (e.g., comprising alumina, silica, titania, zirconia, or a combination thereof). The hydrotreating catalyst according to aspects of this invention can be a bulk catalyst or a supported catalyst. Techniques for producing supported catalysts are well known in the art. Techniques for producing bulk metal catalyst particles are known and have been previously described, for example in U.S. Pat. No. 6,162,350, which is hereby incorporated by reference. Bulk metal catalyst particles can be made via methods where all of the metal catalyst precursors are in solution, or via methods where at least one of the precursors is in at least partly in solid form, optionally but preferably while at least another one of the precursors is provided only in a solution form. Providing a metal precursor at least partly in solid form can be achieved, for example, by providing a solution of the metal precursor that also includes solid and/or precipitated metal in the solution, such as in the form of suspended particles. By way of illustration, some examples of suitable hydrotreating catalysts are described in one or more of U.S. Pat. Nos. 6,156,695, 6,162,350, 6,299,760, 6,582,590, 6,712,955, 6,783,663, 6,863,803, 6,929,738, 7,229,548, 7,288,182, 7,410,924, and 7,544,632, U.S. Patent Application Publication Nos. 2005/0277545, 2006/0060502, 2007/0084754, and 2008/0132407, and International Publication Nos. WO 04/007646, WO 2007/084437, WO 2007/084438, WO 2007/084439, and WO 2007/084471, inter alia. Preferred metal catalysts include cobalt/molybdenum (1-10% Co as oxide, 10-40% Mo as oxide), nickel/molybdenum (1-10% Ni as oxide, 10-40% Co as oxide), or nickel/tungsten (1-10% Ni as oxide, 10-40% W as oxide) on alumina.

In various aspects, hydrotreating conditions can include temperatures of 200° C. to 450° C., or 315° C. to 425° C.; pressures of 250 psig (~1.8 MPag) to 5000 psig (~34.6 MPag) or 500 psig (~3.4 MPag) to 3000 psig (~20.8 MPag), or 800 psig (~5.5 MPag) to 2500 psig (~17.2 MPag); Liquid Hourly Space Velocities (LHSV) of 0.2-10 $h^{-1}$; and hydrogen treat rates of 200 scf/B (35.6 $m^3/m^3$) to 10,000 scf/B (1781 $m^3/m^3$), or 500 (89 $m^3/m^3$) to 10,000 scf/B (1781 $m^3/m^3$).

Hydrotreating catalysts are typically those containing Group 6 metals, and non-noble Group 8-10 metals, i.e., iron, cobalt and nickel and mixtures thereof. These metals or mixtures of metals are typically present as oxides or sulfides on refractory metal oxide supports. Suitable metal oxide supports include low acidic oxides such as silica, alumina or titania, preferably alumina. In some aspects, preferred aluminas can correspond to porous aluminas such as gamma or eta having average pore sizes from 50 to 200 Å, or 75 to 150 Å; a surface area from 100 to 300 $m^2/g$, or 150 to 250 $m^2/g$; and/or a pore volume of from 0.25 to 1.0 $cm^3/g$, or 0.35 to 0.8 $cm^3/g$. The supports are preferably not promoted with a halogen such as fluorine as this generally increases the acidity of the support.

Alternatively, the hydrotreating catalyst can be a bulk metal catalyst, or a combination of stacked beds of supported and bulk metal catalyst. By bulk metal, it is meant that the catalysts are unsupported wherein the bulk catalyst particles comprise 30-100 wt. % of at least one Group 8-10 non-noble metal and at least one Group 6 metal, based on the total weight of the bulk catalyst particles, calculated as metal oxides and wherein the bulk catalyst particles have a surface area of at least 10 $m^2/g$. It is furthermore preferred that the bulk metal hydrotreating catalysts used herein comprise 50 to 100 wt %, and even more preferably 70 to 100 wt %, of at least one Group 8-10 non-noble metal and at least one Group 6 metal, based on the total weight of the particles, calculated as metal oxides. The amount of Group 6 and Group 8-10 non-noble metals can easily be determined VIB TEM-EDX.

Bulk catalyst compositions comprising one Group 8-10 non-noble metal and two Group 6 metals are preferred. It has been found that in this case, the bulk catalyst particles are sintering-resistant. Thus the active surface area of the bulk catalyst particles is maintained during use. The molar ratio of Group 6 to Group 8-10 non-noble metals ranges generally from 10:1-1:10 and preferably from 3:1-1:3, In the case of a core-shell structured particle, these ratios of course apply to the metals contained in the shell. If more than one Group 6 metal is contained in the bulk catalyst particles, the ratio of the different Group 6 metals is generally not critical. The same holds when more than one Group 8-10 non-noble metal is applied. In the case where molybdenum and tungsten are present as Group 6 metals, the molybenum:tungsten ratio preferably lies in the range of 9:1-1:9. Preferably the Group 8-10 non-noble metal comprises nickel and/or cobalt. It is further preferred that the Group 6 metal comprises a combination of molybdenum and tungsten. Preferably, combinations of nickel/molybdenum/tungsten and cobalt/molybdenum/tungsten and nickel/cobalt/molybdenum/tungsten are used. These types of precipitates appear to be sinter-resistant. Thus, the active surface area of the precipitate is maintained during use. The metals are preferably present as oxidic compounds of the corresponding metals, or if the catalyst composition has been sulfided, sulfidic compounds of the corresponding metals.

In some optional aspects, the bulk metal hydrotreating catalysts used herein have a surface area of at least 50 $m^2/g$ and more preferably of at least 100 $m^2/g$. In such aspects, it is also desired that the pore size distribution of the bulk metal hydrotreating catalysts be approximately the same as the one of conventional hydrotreating catalysts. Bulk metal hydrotreating catalysts can have a pore volume of 0.05-5 ml/g, or of 0.1-4 ml/g, or of 0.1-3 ml/g, or of 0.1-2 tag determined by nitrogen adsorption. Preferably, pores smaller than 1 nm are not present. The bulk metal hydrotreating catalysts can have a median diameter of at least 50 nm, or at least 100 nm. The bulk metal hydrotreating catalysts can have a median diameter of not more than 5000 μm, or not more than 3000 μm. In an embodiment, the median particle diameter lies in the range of 0.1-50 μm and most preferably in the range of 0.5-50 μm.

In aspects that include hydrocracking as part of the initial hydroprocessing stage, the initial stage hydrocracking catalyst can comprise any suitable or standard hydrocracking catalyst, for example, a zeolitic base selected from zeolite Beta, zeolite X, zeolite Y, faujasite, ultrastable Y (USY), dealuminized Y (Deal Y), Mordenite, ZSM-3, ZSM-4, ZSM-18, ZSM-20, ZSM-48, and combinations thereof, which zeolitic base can advantageously be loaded with one or more active metals (e.g., either (i) a Group 8-10 noble metal such as platinum and/or palladium or (ii) a Group 8-10 non-noble metal such nickel, cobalt, iron, and combinations thereof, and a Group 6 metal such as molybdenum and/or tungsten). In this discussion, zeolitic materials are defined to include materials having a recognized zeolite framework structure, such as framework structures recognized by the International Zeolite Association. Such zeolitic materials can correspond to silicoaluminates, silicoaluminophosphates, aluminophosphates, and/or other combinations of atoms that can be used to form a zeolitic framework structure. In addition to zeolitic materials, other types of crystalline acidic support materials may also be suitable. Optionally, a zeolitic material and/or other crystalline acidic material may be mixed or bound with other metal oxides such as alumina, titania, and/or silica.

A hydrocracking process in the first stage (or otherwise under sour conditions) can be carried out at temperatures of 200° C. to 450° C., hydrogen partial pressures of from 250 psig to 5000 psig (~1.8 MPag to ~34.6 MPag), liquid hourly space velocities of from 0.2 to 10 $h^{-1}$, and hydrogen treat gas rates of from 35.6 $m^3/m^3$ to 1781 $m^3/m^3$ (~200 SCF/B to ~10,000 SCF/B), Typically, in most cases, the conditions can include temperatures in the range of 300° C. to 450° C., hydrogen partial pressures of from 500 psig to 2000 psig (~3.5 MPag to ~13.9 MPag), liquid hourly space velocities of from 0.3 $h^{-1}$ to 2 $h^{-1}$ and hydrogen treat gas rates of from 213 $m^3/m^3$ to 1068 $m^3/m^3$ (~1200 SCF/B to ~6000 SCF/B).

Additional Second Stage Processing—Dewaxing and Hydrofinishing/Aromatic Saturation After hydroprocessing in the first stage, the hydroprocessed effluent can be separated. In some aspects the separation can correspond to a separation that is primarily focused on separation of contaminant gases ($H_2S$, $NH_3$) that are generated during heteroatom removal. In some aspects, additional lower boiling portions of the hydroprocessed effluent can be separated out, such as naphtha and/or diesel boiling range portions. In such aspects, a lubricant boiling range portion (optionally including a diesel boiling range portion and/or other hydroprocessed bottoms) can be further processed by catalytic dewaxing and/or hydrofinishing or aromatic saturation.

In various aspects, catalytic dewaxing can be included as part of a second or subsequent processing stage. Preferably, the dewaxing catalysts are zeolites (and/or zeolitic crystals) that perform dewaxing primarily by isomerizing a hydrocarbon feedstock. More preferably, the catalysts are zeolites with a unidimensional pore structure. Suitable catalysts include 10-member ring pore zeolites, such as EU-1, ZSM-35 (or ferrierite), ZSM-11, ZSM-57, NU-87, SAPO-11, and ZSM-22. Preferred materials are EU-2, EU-11, ZBM-30, ZSM-48, or ZSM-23. ZSM-48 is most preferred. Note that a zeolite having the ZSM-23 structure with a silica to alumina ratio of from 20:1 to 40:1 can sometimes be referred to as SSZ-32. Other zeolitic crystals that are isostructural with the above materials include Theta-1, NU-10, EU-13, KZ-1, and NU-23.

In various embodiments, the dewaxing catalysts can further include a metal hydrogenation component. The metal hydrogenation component is typically a Group 6 and/or a Group 8-10 metal. Preferably, the metal hydrogenation component is a Group 8-10 noble metal. Preferably, the metal hydrogenation component is Pt, Pd, or a mixture thereof. In an alternative preferred embodiment, the metal hydrogenation component can be a combination of a non-noble Group 8-10 metal with a Group 6 metal. Suitable combinations can include Ni, Co, or Fe with Mo or W, preferably Ni with Mo or W.

The metal hydrogenation component may be added to the dewaxing catalyst in any convenient manner. One technique for adding the metal hydrogenation component is by incipient wetness. For example, after combining a zeolite and a binder, the combined zeolite and binder can be extruded into catalyst particles. These catalyst particles can then be exposed to a solution containing a suitable metal precursor. Alternatively, metal can be added to the catalyst by ion exchange, where a metal precursor is added to a mixture of zeolite (or zeolite and binder) prior to extrusion.

The amount of metal in the dewaxing catalyst can be at least 0.1 wt % based on catalyst, or at least 0.15 wt %, or at least 0.2 wt %, or at least 0.25 wt %, or at least 0.3 wt %, or at least 0.5 wt % based on catalyst. The amount of metal in the catalyst can be 20 wt % or less based on catalyst, or 10 wt % or less, or 5 wt % or less, or 2.5 wt % or less, or 1 wt % or less. For aspects where the metal is Pt, Pd, another Group 8-10 noble metal, or a combination thereof, the amount of metal can be from 0.1 to 5 wt %, preferably from 0.1 to 2 wt %, or 0.25 to 1.8 wt %, or 0.4 to 1.5 wt %. For aspects where the metal is a combination of a non-noble Group 8-10 metal with a Group 6 metal, the combined amount of metal can be from 0.5 wt % to 20 wt %, or 1 wt % to 15 wt %, or 2.5 wt % to 10 wt %.

Preferably, a dewaxing catalyst can be a catalyst with a low ratio of silica, to alumina. For example, for ZSM-48, the ratio of silica to alumina in the zeolite can be less than 200:1, or less than 110:1, or less than 100:1, or less than 90:1, or less than 80:1. In particular, the ratio of silica to alumina can be from 30:1 to 200:1, or 60:1 to 110:1, or 70:1 to 100:1.

A dewaxing catalyst can also include a binder. In some embodiments, the dewaxing catalysts used in process according to the invention are formulated using a low surface area binder, a low surface area binder represents a binder with a surface area of 100 $m^2/g$ or less, or 80 $m^2/g$ or less, or 70 $m^2/g$ or less, such as down to 40 $m^2/g$ or still lower.

Alternatively, the binder and the zeolite particle size can be selected to provide a catalyst with a desired ratio of micropore surface area to total surface area. In dewaxing catalysts used according to the invention, the micropore surface area corresponds to surface area from the unidimensional pores of zeolites in the dewaxing catalyst. The total surface corresponds to the micropore surface area plus the external surface area. Any binder used in the catalyst will not contribute to the micropore surface area and will not significantly increase the total surface area of the catalyst. The external surface area represents the balance of the surface area of the total catalyst minus the micropore surface area. Both the binder and zeolite can contribute to the value of the external surface area. Preferably, the ratio of micropore surface area to total surface area for a dewaxing catalyst will be equal to or greater than 25%.

A zeolite (or other zeolitic material) can be combined with binder in any convenient manner. For example, a bound catalyst can be produced by starting with powders of both the zeolite and binder, combining and mulling the powders with added water to form a mixture, and then extruding the mixture to produce a bound catalyst of a desired size. Extrusion aids can also be used to modify the extrusion flow properties of the zeolite and binder mixture. The amount of framework alumina in the catalyst may range from 0.1 to 3.33 wt %, or 0.1 to 2.7 wt %, or 0.2 to 2 wt %, or 0.3 to 1 wt %.

In yet another embodiment, a binder composed of two or more metal oxides can also be used. In such an embodiment, the weight percentage of the low surface area binder is preferably greater than the weight percentage of the higher surface area binder.

Alternatively, if both metal oxides used for forming a mixed metal oxide binder have a sufficiently low surface area, the proportions of each metal oxide in the binder are less important. When two or more metal oxides are used to form a binder, the two metal oxides can be incorporated into the catalyst by any convenient method. For example, one binder can be mixed with the zeolite during formation of the zeolite powder, such as during spray drying. The spray dried zeolite/binder powder can then be mixed with the second metal oxide binder prior to extrusion. In an aspect, the dewaxing catalyst can be self-bound and does not contain a binder. Process conditions in a catalytic dewaxing zone can include a temperature of from 200 to 450° C., preferably 270 to 400° C., a hydrogen partial pressure of from 1.8 to 34.6 mPa (~250 to ~5000 psi), preferably 4.8 to 20.8 mPa, a liquid hourly space velocity of from 0.2 to 10 $hr^{-1}$, preferably 0.5 to 3.0 $hr^{-1}$, and a hydrogen circulation rate of from 35.6 to 1781 $m^3/m^3$ (~200 to ~10,000 scf/B), preferably 178 to 890.6 $m^3/m^3$ (~1000 to ~5000 scf/B).

In various aspects, a hydrofinishing and/or aromatic saturation process can also be provided. The hydrofinishing and/or aromatic saturation can occur prior to dewaxing and/or after dewaxing. The hydrofinishing and/or aromatic saturation can occur either before or after fractionation. If hydrofinishing and/or aromatic saturation occurs after fractionation, the hydrofinishing can be performed on one or more portions of the fractionated product, such as being performed on one or more lubricant base stock portions. Alternatively, the entire effluent from the last hydrocracking or dewaxing process can be hydrofinished and/or undergo aromatic saturation.

In some situations, a hydrofinishing process and an aromatic saturation process can refer to a single process performed using the same catalyst. Alternatively, one type of catalyst or catalyst system can be provided to perform aromatic saturation, while a second catalyst or catalyst system can be used for hydrofinishing. Typically a hydrofinishing and/or aromatic saturation process will be performed in a separate reactor from dewaxing or hydrocracking processes for practical reasons, such as facilitating use of a lower temperature for the hydrofinishing or aromatic saturation process. However, an additional hydrofinishing reactor following a hydrocracking or dewaxing process but prior to fractionation could still be considered part of a second stage of a reaction system conceptually.

Hydrofinishing and/or aromatic saturation catalysts can include catalysts containing Group 6 metals, Group 8-10 metals, and mixtures thereof. In an embodiment, preferred metals include at least one metal sulfide having a strong hydrogenation function. In another embodiment, the hydrofinishing catalyst can include a Group 8-10 noble metal, such as Pt, Pd, or a combination thereof. The mixture of metals may also be present as bulk metal catalysts wherein the amount of metal is 30 wt. % or greater based on catalyst. Suitable metal oxide supports include low acidic oxides such as silica, alumina, silica-aluminas or titanic, preferably alumina. The preferred hydrofinishing catalysts for aromatic saturation will comprise at least one metal having relatively strong hydrogenation function on a porous support. Typical support materials include amorphous or crystalline oxide materials such as alumina, silica, and silica-alumina. The support materials may also be modified, such as by halogenation, or in particular fluorination. The metal content of the catalyst is often as high as 20 weight percent for non-noble metals. In an embodiment, a preferred hydrofinishing catalyst can include a crystalline material belonging to the M41S class or family of catalysts. The M41S family of catalysts are mesoporous materials having high silica content. Examples include MCM-41, MCM-48 and MCM-50. A preferred member of this class is MCM-41. If separate catalysts are used for aromatic saturation and hydrofinishing, an aromatic saturation catalyst can be selected based on activity and/or selectivity for aromatic saturation, while a hydrofinishing catalyst can be selected based on activity for improving product specifications, such as product color and polynuclear aromatic reduction.

Hydrofinishing conditions can include temperatures from 125° C. to 425° C., preferably 180° C. to 280° C., total pressures from 500 psig (~3.4 MPag) to 3000 psig (~20.7 MPag), preferably 1500 psig (~10.3 MPag) to 2500 psig (~17.2 MPag), and liquid hourly space velocity (LHSV) from 0.1 $hr^{-1}$ to 5 $hr^{-1}$, preferably 0.5 $hr^{-1}$ to 1.5 $hr^{-1}$.

A second fractionation or separation can be performed at one or more locations after a second or subsequent stage. In some aspects, a fractionation can be performed after hydrocracking in the second stage in the presence of the USY catalyst under sweet conditions. At least a lubricant boiling range portion of the second stage hydrocracking effluent can then be sent to a dewaxing and/or hydrofinishing reactor for further processing. In some aspects, hydrocracking and dewaxing can be performed prior to a second fractionation. In some aspects, hydrocracking, dewaxing, and aromatic saturation can be performed prior to a second fractionation. Optionally, aromatic saturation and/or hydrofinishing can be performed before a second fractionation, after a second fractionation, or both before and after.

EXAMPLE 1

Production of Advantaged Basestocks

A hydrocracking process for lubes can be used to produce compositionally advantaged base stocks with superior low temperature and oxidation performance. A wide-cut feed is processed through a first stage which is primarily a hydrotreating unit which boosts viscosity index (VI) and removes sulfur and nitrogen. This is followed by a stripping section where light ends and diesel are removed. The heavier lube fraction then enters the second stage where hydrocracking, dewaxing, and hydrofinishing are done. This corresponds to the configuration shown in FIG. 2, although the configuration in FIG. 3 could alternatively be used. This combination of feed and process can produce a base stock with unique compositional characteristics. These unique compositional characteristics are observed in both the lower and higher viscosity base stocks produced.

The lubricating oil base stocks can be produced by co-processing a wide-cut feed to hit conventional VI targets for the low viscosity cut which yields the low viscosity product with unique compositional characteristics as compared with conventionally processed low viscosity base stocks. The lubricating oil base stock composition can be determined using a combination of advanced analytical techniques including gas chromatography mass spectrometry (GCMS), supercritical fluid chromatography (SFC), carbon-13 nuclear magnetic resonance (13C NMR), proton nuclear magnetic resonance (proton-NMR), two dimensional gas chromatography (2DGC) and differential scanning calorimetry (DSC). Examples of Group II low viscosity lubricating oil base stocks of this disclosure and having a kinematic viscosity at 100° C. in the range of 4-6 cSt are described in FIG. 4. For reference, the low viscosity lubricating oil base stocks of this disclosure are compared with typical Group II low viscosity base stocks having the same viscosity range.

The co-processed high viscosity product from the above described process can also show the unique compositional characteristics described herein. Examples of such Group II high viscosity lubricating oil base stocks having kinematic viscosity at 100° C. in the range of 10-14 cSt are described in FIG. 5. For reference, the high viscosity lubricating oil base stocks of this disclosure are compared with typical Group II high viscosity base stocks having the same viscosity range.

The Group II base stocks with previously unique compositions (examples in FIGS. 4 and 5) produced by the hydrocracking process exhibit a range of base stock viscosities from 3.5 cst to 14 cst. These differences in composition include a difference in distribution of the cycloparaffin ring species and lead to larger relative amounts of one ring compared to multi-ring cycloparaffins. A cycloparaffin performance ratio is defined as the ratio of monocycloparaffinic (hydrogen deficiency X-class of 0) to multi-ring cycloparaffinic and naphthenoaromatic species (sum of species with hydrogen deficiency X-class of −2, −4, −6, −8, and −10) in said base stock relative to the same ratio in a Group II commercially available sample in 2016 or earlier with a kinematic viscosity at 100° C. within 0.3 cSt as the test sample, wherein the amounts of monocycloparaffinic to multi-ring cycloparaffinic and naphthenoaromatic species are all measured using GCMS on the same instrument at the same calibration. FIGS. 4 and 5, referring to line 14 in each, show the cycloparaffin performance ratio for the low viscosity product exceeding 1.05, or 1.1, or 1.2, or 1.3 in the base stocks of this disclosure, and in the high viscosity product exceeding 1.05, or 1.1, or even more preferably exceeding 1.2, or 1.3, or 1.4 in the base stocks of this disclosure.

Additionally, in these base stocks of this disclosure, the absolute value of multi-ring cycloparaffins as show in FIGS. 4 and 5, rows 15, 16, and 17 of each, for 2+, 3+, 4+ ring cycloparaffins is lower in the base stocks of this disclosure as compared to commercially known stocks across the range of viscosities. Specifically, the example base stocks of this disclosure show less than 35.7% 2+ ring cycloparaffins, less than 11.0% 3+ ring cycloparaffins and less than 3.7% 4+ ring cycloparaffins in the low viscosity product, and less than 39% 2+ ring cycloparaffins, less than 10.8% 3+ ring cycloparaffins and less than 3.2% 4+ ring cycloparaffins for the high viscosity product. The lower amounts of the multi-ring cycloparaffins can also be seen by looking at individual numbers of 3 ring species (FIGS. 4 and 5, line 7 of each); less than 7.8% for the low viscosity product and less than 7.9% for the high viscosity product. Additionally, the base stocks of this disclosure also show higher amounts of the monocycloparaffin species across the full viscosity range; greater than 40.7% for the low viscosity base stocks and greater than 38.8% for the high viscosity base stocks.

Further, using a wide cut feed gives additional advantages on the heavier base stocks co-produced with the lighter base stocks. As seen in FIG. 5, line 4 thereof, the high viscosity stocks show significantly lower total cycloparaffin content (less than 75%) compared to commercial base stocks, averaging closer to 80%. This is also evidenced by higher VI, exceeding 109.3 where the base stocks of this disclosure have VI in the 109-112 range.

Additionally, the high viscosity base stocks show lower degree of branching on the iso-paraffin portion of the species as evidenced by greater than 13.3 epsilon carbon atoms per 100 carbon atoms as measured by 13C-NMR, and a greater number of long alkyl branches on iso-paraffin portion of the species as evidence by greater than 2.8 alpha carbon atoms per 100 carbon atoms as measured by 13C-NMR (FIG. 5, lines 18 and 20). Some unique combinations of properties are also seen specifically in the low viscosity base stock co-produced with the high viscosity product. For example, the low viscosity base stocks of this disclosure have epsilon carbon content less than 12% while retaining viscosity index greater than 110 (FIG. 4, lines 18 and 3).

The base stocks of this disclosure have lower contents of total cycloparaffins as compared to the typical Group II base stocks. This is believed to provide the VI advantage of the base stocks of this disclosure over competitive base stocks. Surprisingly, the base stocks of this disclosure also have higher content of the X=0 ring class species (corresponding to monocycloparaffinic species), despite the lower overall cycloparaffin content and naphthenoaromatic species content. While not being bound by theory, one hypothesis for the lower amounts of multi-ring cycloparaffins and naphthenoaromatics is that ring opening reactions that lead to low multi-ring cycloparaffins and naphthenoaromatics may have high selectivity under the process conditions used to make the base stocks of this disclosure. The process scheme used to make the base stocks of this disclosure enables greater use of noble metal catalysts having acidic sites under low sulfur (sweet) processing conditions that may favor ring opening reactions that potentially improve VI.

EXAMPLE 2

Aromatic Saturation during Sour and Sweet Operation

FIGS. 1-3 provide configurations where a feed is initially hydroprocessed under sour conditions (e.g., sulfur content greater than 250 wppm) followed by hydrocracking of at least a lubricant boiling range portion in the presence of a USY catalyst as described above under sweet conditions (e.g., combined liquid phase and gas phase sulfur equivalent to sulfur content of 100 wppm or less.) The benefits of performing hydrocracking in the presence of the USY catalyst under sweet conditions can be shown in comparison with hydrocracking under sour conditions according to a conventional configuration.

In this example, an aromatic feedstock suitable for lubricant base stock production was processed in two different configurations. Configuration A corresponds to a configuration where hydrotreating and hydrocracking are performed in a single stage. Commercially available hydrotreating catalysts and commercially available base metal hydrocracking catalyst was used. Configuration B corresponds to a configuration similar to FIG. 1. In Configuration B, commercially available hydrotreatment catalysts were used in a first stage to reduce the sulfur content of the feed to less than 100 wppm. The first stage effluent was then separated to remove light ends and to also remove portions of the feed having a boiling point of less than 700° F. (~371° C.). The remaining lubricant boiling range fraction was then hydrocracked in the presence of a noble metal USY catalyst. The noble metal USY catalyst was a USY catalyst with a unit cell size of less than 24.30, a silica to alumina ratio of greater than 50, and an alpha value of 20 or less. The noble metal USY catalyst further included 1.0 wt % of Pt, based on the weight of the support. The hydrogen pressure for both configurations was 2200 psig (~15.2 MPag). The temperature was selected to generate effluents having less than 100 wppm of sulfur, and also to achieve a desired level of feed conversion relative to 700° F. (~371° C.). For Configuration B, the amount of conversion is the total conversion across both the hydrotreatment and hydrocracking reactors.

Figure 6:
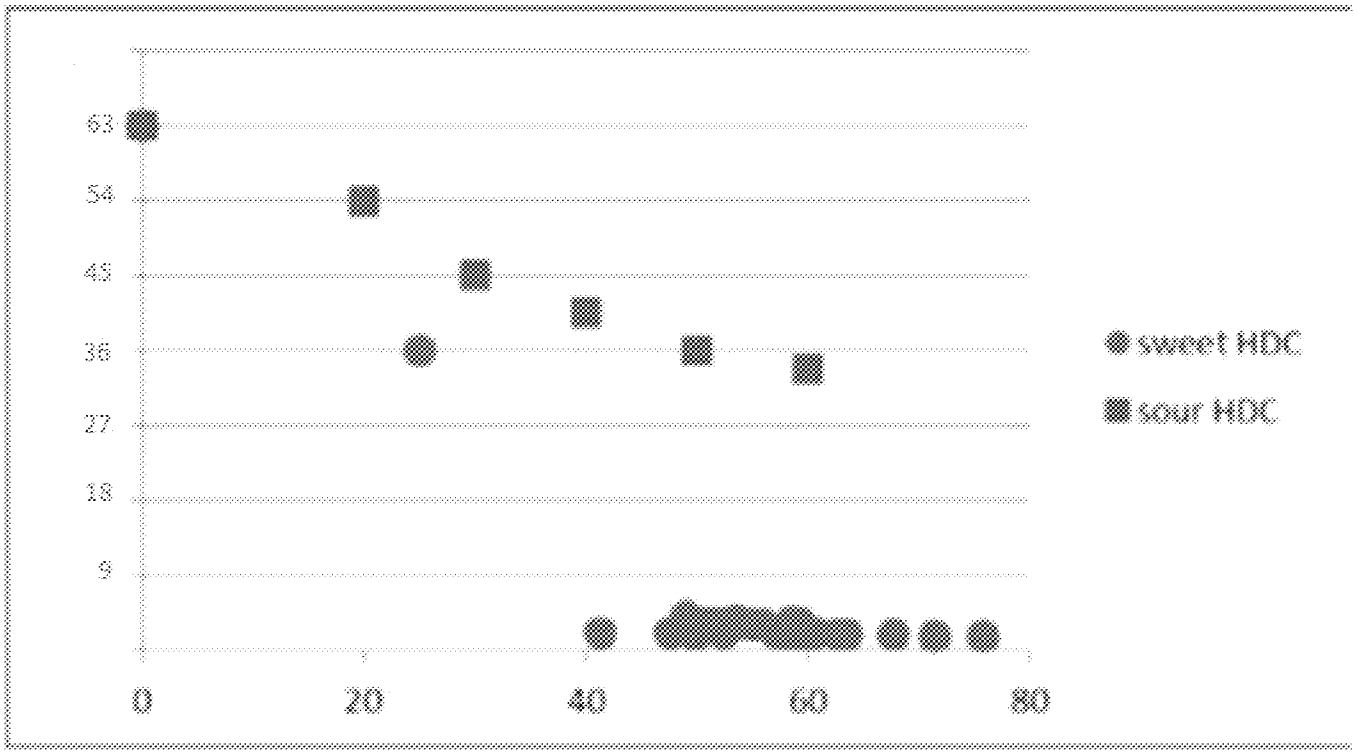
FIG. 6 shows aromatic saturation relative to 700° F. (~371° C.) conversion for hydrocracking under sour conditions and under sweet conditions.

FIG. 6 shows the aromatics content (wt %) in the hydroprocessed effluent for Configuration A (squares, sour hydrocracking) and Configuration B (circles, sweet hydrocracking). The amount of aromatics in the hydroprocessed effluent is shown relative to the amount of combined 700° F. (~371° C.) conversion performed during hydroprocessing (hydrotreating plus hydrocracking). With regard to aromatic content, the aromatic content of a feedstock (such as a lubricant boiling range feed) can be determined by any convenient method. ASTM D2007 provides an example of a method for measuring aromatics in lubricant boiling range feed.

The square at 0% conversion indicates the aromatics content of the feed, which was roughly 65 wt %. At 700° F. (~371° C.) conversion levels of ~25% or less, the conversion and aromatic saturation shown in FIG. 6 corresponds to aromatic saturation and conversion due to hydrotreating only. Conversion levels greater than 25% correspond to hydrotreating followed by hydrocracking. At higher levels of conversion, sweet hydrocracking in the presence of the USY catalyst resulted in aromatic contents in the hydrocracked effluent of roughly ~2 to ~4 wt %. By contrast, increasing the 700° F. (~371° C.) conversion under sour conditions was effective for achieving up to 60% conversion of the feed, but the aromatics content was at least ~35 wt % at all levels of conversion for sour hydrocracking. This demonstrates the ability of sweet hydrocracking in the presence of a USY catalyst to provide improved aromatic saturation relative to sour hydrocracking.

EXAMPLE 3

Aromatic Saturation with Liquid Quench

Processing of a feed similar to the feed in Example 2 was modeled using an empirical model that was fit and verified against both lab scale and commercial scale hydroprocessing runs. Processing of the feed was modeled using two different configurations. Configuration C corresponded to a configuration similar FIG. 2, while Configuration D corresponded to configuration similar to FIG. 3. Configuration C was modeled to include use of a quench gas to reduce the temperature of the hydrocracked effluent prior to dewaxing. Configuration D was modeled to include a recycle of 25 wt % of the dewaxed effluent for combination with the hydrocracked effluent.

In both configurations, an initial sour hydroprocessing stage was used to reduce heteroatom content. Hydrocracking, dewaxing, and hydrofinishing were then performed in the second "sweet" stage. For both configurations, a noble metal USY catalyst (as described in Example 2) was used for hydrocracking, a 0.6 wt % Pt-ZSM-48 catalyst was used for dewaxing, and commercially available hydrofinishing catalyst was used for hydrofinishing. After hydrofinishing, the (non-recycled) portion of the dewaxed effluent was fractionated to form fuels fractions, a light neutral base stock (4-6 cSt), and a heavy neutral base stock (10-14 cSt).

The hydrocracking in both configurations was performed at 2200 psig (~15.2 MPag). Table 1 below provides additional details regarding the temperatures during the modeled processing runs. In Table 1, EIT refers to estimated internal temperature, which is roughly an average of the inlet and exit temperatures for a reactor.

TABLE 1

| | Configuration C | Configuration D |
|---|---|---|
| HDC EIT ° C. | 367 | 367 |
| Dewax Feed temperature (inlet) ° C. | 367 | 352 |
| Dewax EIT ° C. | 343 | 343 |
| High P quench gas rate | base | 30% of base |
| Light Neutral aromatics, wt % | ~2.4 wt % | ~1.2 wt % |
| Heavy Neutral aromatics, wt %. | ~2.2 wt % | ~1.3 wt % |

As shown in Table 1 above, the hydrocracking reactors in Configurations C and D were run at the same temperature. The dewaxing reactors were also run at the same temperature, which was roughly 25° C. cooler than the hydrocracking reactors. Using the gas phase quench only in Configuration C, the hydrocracked effluent could only be cooled by roughly 10° C., which caused the input to the dewaxing reactor to have roughly the same temperature as the estimated internal temperature of the hydrocracking reactor. By contrast, the liquid quench in Configuration D was able to cool the hydrocracked effluent (or dewaxing feed) much more substantially, corresponding to roughly 25° C. of cooling. Thus, the feed to dewaxing in Configuration D is closer to the average temperature of the dewaxing reactor. Additionally, Configuration D allows the recycled portion of the dewaxing effluent to be exposed to the dewaxing and hydrofinishing catalysts a second time, allowing for further reduction in aromatics and pour points This led to improvements in oxidation time as measured by the Rotary Pressure Vessel Oxidation test. A turbine oil blended with the heavy neutral sample from Configuration C gave a 825 minutes RPVOT time, while the RPVOT time in the same formulation blended with the heavy netural sample from Configuration D gave a 1006 minutes RPVOT time. This would also be expected to lead to improvements in low temperature performance.

Additional Embodiments

Embodiment 1. A method for producing a lubricant boiling range product, comprising: hydroprocessing a feedstock comprising a 650° F. (~343° C.) portion under first hydroprocessing conditions to form a hydroprocessed effluent; fractionating at least a portion of the hydroprocessed effluent to form at least a first fuels boiling range fraction and a second fraction, the second fraction comprising a lubricant boiling range portion; hydrocracking the second fraction in the presence of hydrocracking catalyst under hydrocracking conditions to form a hydrocracked effluent, the hydrocracking catalyst comprising USY zeolite having a unit cell size of 24.30 Å or less, a silica to alumina ratio of at least 50, and an Alpha value of 20 or less, the hydrocracking catalyst further comprising 0.1 wt % to 5.0 wt % of a Group 8-10 noble metal supported on the hydrocracking catalyst, the hydrocracking conditions comprising a hydrocracking reactor exit temperature; dewaxing at least a portion of the hydrocracked effluent and a recycled portion of a dewaxed effluent under catalytic dewaxing conditions to form a dewaxed effluent, the recycled portion of the dewaxed effluent optionally comprising 20 wt % to 50 wt % of the dewaxed effluent, the catalytic dewaxing conditions comprising a dewaxing reactor inlet temperature that is at least 20° C. lower than the hydrocracking reactor exit temperature, or at least 25° C., or at least 30° C.; separating at least a portion of the dewaxed effluent to form at least the recycled portion of the dewaxed effluent and a product portion of the dewaxed effluent; and fractionating the product portion of the dewaxed effluent to form at least a fuels boiling range product and a lubricant boiling range product, wherein the lubricant boiling range product has an aromatics content of 2.0 wt % or less, or 1.5 wt % or less, or 1.0 wt % or less.

Embodiment 2. The method of Embodiment 1, further comprising hydrofinishing at least a portion of the dewaxed effluent to form a hydrofinished effluent, the separating at least a portion of the dewaxed effluent comprising separating at least a portion of the hydrofinished effluent.

Embodiment 3. The method of any of the above embodiments, wherein the dewaxing reactor inlet temperature is less than 15° C. greater than a dewaxing weight average bed temperature, or less than 10° C. greater.

Embodiment 4. The method of any of the above embodiments, wherein fractionating the product portion of the dewaxed effluent comprises forming at least a first lubricant boiling range product and a second lubricant boiling range product, the first lubricant boiling range product having an aromatics content of 2.0 wt % or less, or 1.5 wt % or less, or 1.0 wt % or less, and the second lubricant boiling range product having an aromatics content of 2.0 wt % or less, or 1.5 wt % or less, or 1.0 wt % or less; and wherein the first lubricant boiling range product optionally has a viscosity of 4 to 6 cSt, wherein the second lubricant boiling range product optionally has a viscosity of 10-14 cSt, or a combination thereof.

Embodiment 6. The method of any of the above embodiments, wherein the feedstock comprises at least 40 wt % aromatics, or at least 50 wt %.

Embodiment 7. The method of any of the above embodiments, wherein the hydrocracking catalyst comprises a USY zeolite having one or more (or two or more, or all) of a unit cell size of 24.24 Å or less, a silica to alumina ratio of at least 85, and an Alpha value of 10 or less, the USY zeolite optionally comprising a Meso-Y zeolite, an Extra Mesoporous Y zeolite, or a combination thereof.

Embodiment 8. The method of any of the above embodiments, wherein hydroprocessing the feedstock comprising exposing the feedstock to a hydrotreating catalyst under hydrotreating conditions, or wherein hydroprocessing the feedstock comprises exposing the feedstock to a second hydrocracking catalyst under second hydrocracking conditions, or a combination thereof.

Embodiment 9. A system for producing a lubricant boiling range product, comprising: a hydrotreating reactor comprising a hydrotreating feed inlet, a hydrotreating effluent outlet, and at least one fixed catalyst bed comprising a hydrotreating catalyst; a separation stage having a first separation stage inlet and a second separation stage inlet, the first separation stage inlet being in fluid communication with the hydrotreating effluent outlet, the separation stage further comprising a plurality of separation stage liquid effluent outlets, one or more of the separation stage liquid effluent outlets corresponding to product outlets; a hydrocracking reactor comprising a hydrocracking feed inlet, a hydrocracking effluent outlet, and at least one fixed catalyst bed comprising a hydrocracking catalyst, the hydrocracking feed inlet being in fluid communication with at least one separation stage liquid effluent outlet, and the hydrocracking catalyst comprising USY zeolite having a unit cell size of 24.30 Å or less, a silica to alumina ratio of at least 50, and an Alpha value of 20 or less, the hydrocracking catalyst further comprising 0.1 wt % to 5.0 wt % of a Group 8-10 noble metal supported on the hydrocracking catalyst; and a dewaxing reactor comprising a dewaxing feed inlet, a dewaxing effluent outlet, and at least one fixed catalyst bed comprising a dewaxing catalyst, the dewaxing feed inlet being in fluid communication with the hydrocracking effluent outlet and being in fluid communication with the dewaxing effluent outlet.

Embodiment 10. The system of Embodiment 9, wherein the dewaxing reactor further comprises a fixed bed comprising a hydrofinishing catalyst, wherein the hydrotreating reactor further comprises a fixed bed comprising a hydrocracking catalyst, or a combination thereof.

Embodiment 11. The system of Embodiment 9 or 10, further comprising a hydrofinishing reactor comprising a hydrofinishing feed inlet, a hydrofinishing effluent outlet, and at least one fixed catalyst bed comprising a hydrofinishing catalyst, the hydrofinishing feed inlet being in direct fluid communication with the dewaxing feed outlet, the dewaxing feed inlet being in direct fluid communication with the hydrofinishing effluent outlet and in indirect fluid communication with the dewaxing effluent outlet.

Embodiment 12. The system of any of Embodiments 9 to 11, the system further comprising an additional hydrocracking reactor comprising an additional hydrocracking feed inlet, an additional hydrocracking effluent outlet, and at least one fixed catalyst bed comprising an additional hydrocracking catalyst, the additional hydrocracking reactor providing indirect fluid communication between the hydrotreating effluent outlet and the first separation stage inlet, the additional hydrocracking feed inlet being in fluid communication with the hydrotreating effluent outlet, the additional hydrocracking effluent outlet being in fluid communication with the first separation stage inlet.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

The present invention has been described above with reference to numerous embodiments and specific examples. Many variations will suggest themselves to those skilled in this art in light of the above detailed description. All such obvious variations are within the full intended scope of the appended claims.

The invention claimed is:

1. A method for producing a lubricant boiling range product, comprising:

hydroprocessing a feedstock comprising a portion having an initial boiling point of at least 650° F. (~343° C.) under first hydroprocessing conditions to form a hydroprocessed effluent;

fractionating at least a portion of the hydroprocessed effluent to form at least a first fuels boiling range fraction and a second fraction, the second fraction comprising a lubricant boiling range portion;

hydrocracking the second fraction in the presence of a hydrocracking catalyst under hydrocracking conditions in a first reactor to form a hydrocracked effluent, the hydrocracking catalyst comprising USY zeolite having a unit cell size of 24.30 Å or less, a silica to alumina ratio of at least 50, and an Alpha value of 20 or less, the hydrocracking catalyst further comprising 0.1 wt % to 5.0 wt % of a Group 8-10 noble metal supported on the hydrocracking catalyst, the hydrocracking conditions comprising a hydrocracking reactor exit temperature;

dewaxing at least a portion of the hydrocracked effluent and a recycled portion of a dewaxed effluent under catalytic dewaxing conditions in a second reactor to form a dewaxed effluent, the catalytic dewaxing conditions comprising a dewaxing reactor inlet temperature that is at least 20° C. lower than the hydrocracking reactor exit temperature;

separating at least a portion of the dewaxed effluent to form at least the recycled portion of the dewaxed effluent and a product portion of the dewaxed effluent; and fractionating the product portion of the dewaxed effluent to form at least:

a fuels boiling range product;

a first lubricant boiling range product having an aromatics content of 2.0 wt % or less and a kinematic viscosity (100° C.) of 4 to 6 cSt, wherein the first lubricant boiling range product comprises less than 35.7% 2+ ring cycloparaffins, less than 11.0% 3+ ring cycloparaffins, and less than 3.7% 4+ ring cycloparaffins, and a second lubricant boiling range product having an aromatics content of 2.0 wt % or less and a kinematic viscosity (100° C.) of 10 to 14 cSt.

2. The method of claim 1, further comprising hydrofinishing at least a portion of the dewaxed effluent to form a hydrofinished effluent, the separating at least a portion of the dewaxed effluent comprising separating at least a portion of the hydrofinished effluent.

3. The method of claim 1, wherein the feedstock has a solvent dewaxed viscosity index of 20 to 45.

4. The method of claim 1, wherein the recycled portion of the dewaxed effluent comprises 20 wt % to 50 wt % of the dewaxed effluent.

5. The method of claim 1, wherein the dewaxing reactor inlet temperature is less than 15° C. greater than a dewaxing weight average bed temperature.

6. The method of claim 1, wherein the second lubricant boiling range product comprises less than 39% 2+ ring cycloparaffins, less than 10.8% 3+ ring cycloparaffins, and less than 3.2% 4+ ring cycloparaffins.

7. The method of claim 1, wherein the feedstock comprises at least 40 wt % aromatics.

8. The method of claim 1, wherein the hydrocracking catalyst comprises a USY zeolite having one or more of a unit cell size of 24.24 Å or less, a silica to alumina ratio of at least 85, and an Alpha value of 10 or less.

9. The method of claim 1, wherein the USY zeolite comprises a Meso-Y zeolite, an Extra Mesoporous Y zeolite, or a combination thereof.

10. The method of claim 1, wherein hydroprocessing the feedstock comprises exposing the feedstock to a hydrotreating catalyst under hydrotreating conditions, or wherein hydroprocessing the feedstock comprises exposing the feedstock to a second hydrocracking catalyst under second hydrocracking conditions, or a combination thereof.

11. The method of claim 1, wherein the second lubricant boiling range product comprises a total cycloparaffin content of less than 75 wt %.

12. The method of claim 1, wherein:

the first lubricant boiling range product comprises monocycloparaffinic species of 0 X-class, wherein the monocycloparaffinic species are 41 wt % or more; or the second lubricant boiling range product comprises monocycloparaffinic species of 0 X-class, wherein the monocycloparaffinic species are 39 wt % or more.

13. A method for producing a lubricant boiling range product, comprising:

hydroprocessing a feedstock comprising a portion having an initial boiling point of at least 650° F. (~343° C.) under first hydroprocessing conditions to form a hydroprocessed effluent;

fractionating at least a portion of the hydroprocessed effluent to form at least a first fuels boiling range fraction and a second fraction, the second fraction comprising a lubricant boiling range portion;

hydrocracking the second fraction in the presence of a hydrocracking catalyst under hydrocracking conditions in a first reactor to form a hydrocracked effluent, the hydrocracking catalyst comprising USY zeolite having a unit cell size of 24.30 Å or less, a silica to alumina ratio of at least 50, and an Alpha value of 20 or less, the hydrocracking catalyst further comprising 0.1 wt % to 5.0 wt % of a Group 8-10 noble metal supported on the hydrocracking catalyst, the hydrocracking conditions comprising a hydrocracking reactor exit temperature;

dewaxing at least a portion of the hydrocracked effluent and a recycled portion of a dewaxed effluent under catalytic dewaxing conditions in a second reactor to form a dewaxed effluent, the catalytic dewaxing conditions comprising a dewaxing reactor inlet temperature that is at least 20° C. lower than the hydrocracking reactor exit temperature;

separating at least a portion of the dewaxed effluent to form at least the recycled portion of the dewaxed effluent and a product portion of the dewaxed effluent; and fractionating the product portion of the dewaxed effluent to form at least:

a fuels boiling range product;

a first lubricant boiling range product having an aromatics content of 2.0 wt % or less and a kinematic viscosity (100° C.) of 4 to 6 cSt; and a second lubricant boiling range product having an aromatics content of 2.0 wt % or less and a kinematic viscosity (100° C.) of 10 to 14 cSt, wherein the second lubricant boiling range product comprises less than 39% 2+ ring cycloparaffins, less than 10.8% 3+ ring cycloparaffins, and less than 3.2% 4+ ring cycloparaffins.

14. The method of claim 13, wherein the second lubricant boiling range product comprises a total cycloparaffin content of less than 75 wt %.

15. The method of claim 13, wherein the first lubricant boiling range product comprises less than 35.7% 2+ ring cycloparaffins, less than 11.0% 3+ ring cycloparaffins, and less than 3.7% 4+ ring cycloparaffins.

16. A method for producing a lubricant boiling range product, comprising:

hydroprocessing a feedstock comprising a portion having an initial boiling point of at least 650° F. (~343° C.) under first hydroprocessing conditions to form a hydroprocessed effluent;

fractionating at least a portion of the hydroprocessed effluent to form at least a first fuels boiling range fraction and a second fraction, the second fraction comprising a lubricant boiling range portion;

hydrocracking the second fraction in the presence of a hydrocracking catalyst under hydrocracking conditions in a first reactor to form a hydrocracked effluent, the hydrocracking catalyst comprising USY zeolite having a unit cell size of 24.30 Å or less, a silica to alumina ratio of at least 50, and an Alpha value of 20 or less, the hydrocracking catalyst further comprising 0.1 wt % to 5.0 wt % of a Group 8-10 noble metal supported on the hydrocracking catalyst, the hydrocracking conditions comprising a hydrocracking reactor exit temperature;

dewaxing at least a portion of the hydrocracked effluent and a recycled portion of a dewaxed effluent under catalytic dewaxing conditions in a second reactor to form a dewaxed effluent, the catalytic dewaxing conditions comprising a dewaxing reactor inlet temperature that is at least 20° C. lower than the hydrocracking reactor exit temperature;

separating at least a portion of the dewaxed effluent to form at least the recycled portion of the dewaxed effluent and a product portion of the dewaxed effluent; and fractionating the product portion of the dewaxed effluent to form at least:

a fuels boiling range product;

a first lubricant boiling range product having an aromatics content of 2.0 wt % or less and a kinematic viscosity (100° C.) of 4 to 6 cSt, wherein the first lubricant boiling range product comprises less than 35.7% 2+ ring cycloparaffins, less than 11.0% 3+ ring cycloparaffins, and less than 3.7% 4+ ring cycloparaffins; and a second lubricant boiling range product having an aromatics content of 2.0 wt % or less and a kinematic viscosity (100° C.) of 10 to 14 cSt, wherein the second lubricant boiling range product comprises less than 39% 2+ ring cycloparaffins, less than 10.8% 3+ ring cycloparaffins, and less than 3.2% 4+ ring cycloparaffins.

17. The method of claim 16, wherein:

the first lubricant boiling range product comprises monocycloparaffinic species of 0 X-class, wherein the monocycloparaffinic species are 41 wt % or more; or the second lubricant boiling range product comprises monocycloparaffinic species of 0 X-class, wherein the monocycloparaffinic species are 39 wt % or more.

* * * * *